US011442391B2

(12) United States Patent
Sugiyama et al.

(10) Patent No.: US 11,442,391 B2
(45) Date of Patent: Sep. 13, 2022

(54) DRIVE CONTROL DEVICE, DRIVING DEVICE, SHEET CONVEYING DEVICE, AND IMAGE FORMING APPARATUS

(71) Applicants: Keisuke Sugiyama, Kanagawa (JP); Hidehiko Fujiwara, Tokyo (JP); Jun Yamada, Kanagawa (JP); Takashi Saito, Kanagawa (JP); Ikuhisa Okamoto, Kanagawa (JP)

(72) Inventors: Keisuke Sugiyama, Kanagawa (JP); Hidehiko Fujiwara, Tokyo (JP); Jun Yamada, Kanagawa (JP); Takashi Saito, Kanagawa (JP); Ikuhisa Okamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 366 days.

(21) Appl. No.: 16/583,741

(22) Filed: Sep. 26, 2019

(65) Prior Publication Data

US 2020/0103811 A1 Apr. 2, 2020

(30) Foreign Application Priority Data

Sep. 27, 2018 (JP) ..... JP2018-182496

(51) Int. Cl.
*B65H 3/06* (2006.01)
*G03G 15/00* (2006.01)

(52) U.S. Cl.
CPC ..... *G03G 15/6529* (2013.01); *B65H 3/0669* (2013.01); *B65H 2403/944* (2013.01); *G03G 2221/1657* (2013.01)

(58) Field of Classification Search
CPC .. B65H 2403/944; B65H 3/0669; B60K 6/48; B60K 2006/4808; B60K 2006/4816;
(Continued)

(56) References Cited

U.S. PATENT DOCUMENTS 6,139,324 A * 10/2000 Roy ..... G09B 9/00 434/55
8,994,316 B2 * 3/2015 Asensio ..... H02P 8/40 318/696

(Continued)

FOREIGN PATENT DOCUMENTS

CN 101187793 5/2008
CN 202019334 10/2011

(Continued)

OTHER PUBLICATIONS

Chinese Notice of Allowance dated Apr. 13, 2022 for corresponding Chinese Application No. 201910908065.9 with English Translation.

(Continued)

*Primary Examiner* — Jeremy R Severson
(74) *Attorney, Agent, or Firm* — Harness, Dickey & Pierce, P.L.C.

(57) ABSTRACT

A drive control device is configured to control a plurality of drive sources configured to drive a single output shaft. The drive control device includes a control unit configured to generate a single drive control signal and transmit the drive control signal to the plurality of drive sources. The drive control device has, as operation modes, a first mode for driving the plurality of drive sources and a second mode for driving a part of the plurality of drive sources.

16 Claims, 14 Drawing Sheets

(58) Field of Classification Search
CPC .... B60K 2006/4825; B60K 2006/4833; G03G 15/6529; G03G 2221/1657
See application file for complete search history.

(56) References Cited

U.S. PATENT DOCUMENTS

| | | | | |
|---|---|---|---|---|
| 9,027,925 | B2 * | 5/2015 | Alaas | B65H 5/062 271/259 |
| 9,159,002 | B2 * | 10/2015 | Takata | B65H 29/60 |
| 2008/0118274 | A1 | 5/2008 | Ahn et al. | |
| 2014/0187407 | A1 | 7/2014 | Kikuchi et al. | |
| 2014/0203486 | A1 | 7/2014 | Sugiyama et al. | |
| 2014/0203487 | A1 | 7/2014 | Hoshino et al. | |
| 2014/0203488 | A1 | 7/2014 | Hidaka et al. | |
| 2014/0203501 | A1 | 7/2014 | Hoshino et al. | |
| 2014/0206516 | A1 | 7/2014 | Hata et al. | |
| 2014/0206517 | A1 | 7/2014 | Kikuchi et al. | |
| 2014/0206518 | A1 | 7/2014 | Hidaka et al. | |
| 2014/0206519 | A1 | 7/2014 | Hoshino et al. | |
| 2014/0213425 | A1 | 7/2014 | Sugiyama et al. | |
| 2014/0319755 | A1 | 10/2014 | Alaas et al. | |
| 2014/0368848 | A1 | 12/2014 | Takata | |
| 2015/0045197 | A1 | 2/2015 | Sugiyama et al. | |
| 2015/0065326 | A1 | 3/2015 | Musha et al. | |
| 2015/0115516 | A1 | 4/2015 | Satoh et al. | |
| 2015/0123342 | A1 | 5/2015 | Furuhashi et al. | |
| 2015/0253716 | A1 | 9/2015 | Nagasako et al. | |
| 2015/0353315 | A1 | 12/2015 | Suzuki et al. | |
| 2016/0115000 | A1 | 4/2016 | Sugiyama et al. | |
| 2016/0185552 | A1 | 6/2016 | Hoshino et al. | |
| 2016/0221787 | A1 | 8/2016 | Matsushita et al. | |
| 2017/0260015 | A1 | 9/2017 | Shimazu et al. | |
| 2018/0167528 | A1 * | 6/2018 | Kuroki | H04N 1/00 |

FOREIGN PATENT DOCUMENTS

| | | |
|---|---|---|
| CN | 104053617 A | 9/2014 |
| JP | H0297974 | 4/1990 |
| JP | 2002247793 | 8/2002 |
| JP | 2005-213039 | 8/2005 |
| JP | 2010-041747 | 2/2010 |
| JP | 4682996 | 5/2011 |
| JP | 2012-135073 A | 7/2012 |
| JP | 2017-151528 | 8/2017 |

OTHER PUBLICATIONS

Chinese Office Action and English translation thereof dated Nov. 2, 2021.

Japanese Office Action dated Jun. 17, 2022 for corresponding Japanese Patent Application No. 2018-182496.

* cited by examiner

DRIVE CONTROL DEVICE, DRIVING DEVICE, SHEET CONVEYING DEVICE, AND IMAGE FORMING APPARATUS

CROSS-REFERENCE TO RELATED APPLICATIONS

The present application claims priority under 35 U.S.C. § 119 to Japanese Patent Application No. 2018-182496, filed on Sep. 27, 2018. The contents of which are incorporated herein by reference in their entirety.

BACKGROUND OF THE INVENTION

1. Field of the Invention

The present invention relates to a drive control device, a driving device, a sheet conveying device, and an image forming apparatus.

2. Description of the Related Art

Conventionally, a drive control device that controls a plurality of drive sources for driving a single output shaft has been known.

Japanese Laid-open Patent Publication No. 2017-151528 describes a device, as the above-described drive control device, in which control units that generate and transmit drive control signals for controling drive of a plurality of drive sources are each provided for one of the drive sources in order to improve vibration damping property of the device.

Even a single control unit can control drive of a plurality of drive sources unlike the device described in Japanese Laid-open Patent Publication No. 2017-151528, and, in a device in which priority is given to reduction of costs and size rather than functionalities, it is preferable to adopt a configuration in which a single control unit controls a plurality of drive sources. However, in the configuration in which the single control unit controls the plurality of drive sources, it is difficult to detect a failure of each of the drive sources.

SUMMARY OF THE INVENTION

According an aspect of the present invention, a drive control device is configured to control a plurality of drive sources configured to drive a single output shaft. The drive control device includes a control unit configured to generate a single drive control signal and transmit the drive control signal to the plurality of drive sources. The drive control device has, as operation modes, a first mode for driving the plurality of drive sources and a second mode for driving a part of the plurality of drive sources.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
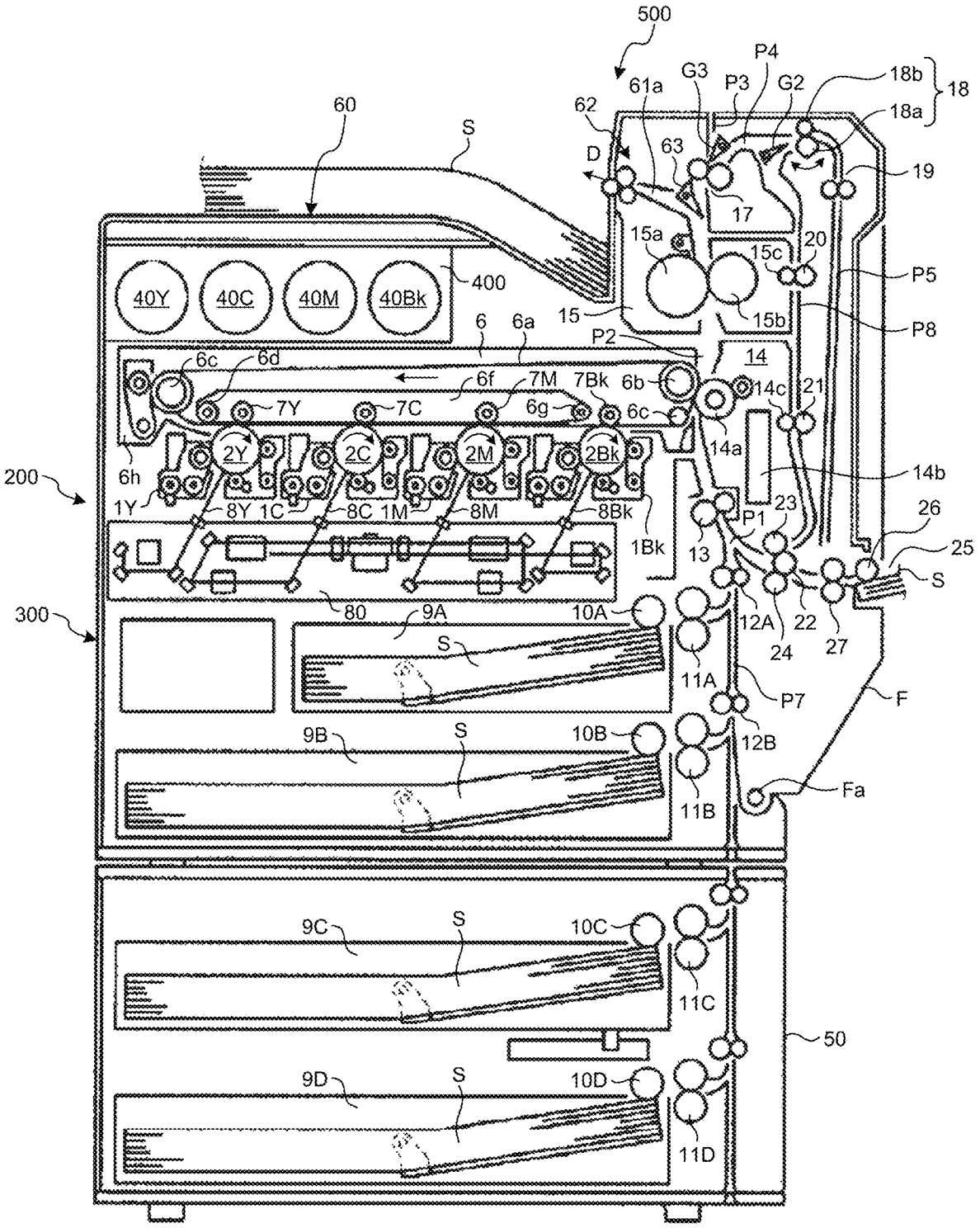
FIG. 1 is a schematic configuration diagram of a printer according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Hereinafter, one embodiment of a tandem-type color laser printer (hereinafter, simply referred to as a "printer 500") in which a plurality of photoconductors are arranged in tandem will be described, based on FIG. 1 to FIG. 3, as an image forming apparatus that includes a driving device of the present invention.

The present invention is applicable to other image forming apparatuses, such as a copier, a facsimile machine, and a multifunction peripheral (MFP) having any two or three of functions of a copier, a facsimile machine, and a printer, in addition to the color laser printer. In addition, the present invention is applicable to an image reading device that does not include an image forming apparatus.

FIG. 1 is a schematic configuration diagram of the printer 500 according to the present embodiment. The printer 500 includes an image formation unit 200, a sheet feed unit 300 on which the image formation unit 200 is mounted, and the like. The printer 500 includes, inside thereof, four image formation units 1 (Y, M, C, Bk) as image forming units for forming images of a plurality of colors of yellow (Y), cyan (C), magenta (M), and black (Bk). The image formation units 1 (Y, M, C, Bk) include drum-shaped photoconductors 2 (Y, M, C, Bk), and the four photoconductors 2 (Y, M, C, Bk) are arranged so as to be separated at equals in a horizontal direction in the figure in the image formation unit 200. Each of the photoconductors 2 (Y, M, C, Bk) rotates in a direction of arrow by receiving drive from a drive source when the printer 500 is operated.

Components and devices, such as a developing device, that are needed for image formation of an electrophotographic system are disposed around each of the photoconductors 2 (Y, M, C, Bk), so that the four image formation units 1 (Y, M, C, Bk) are constructed. In the descriptions of the present embodiment, for the sake of convenience, symbols of Y (yellow), C (cyan), M (magenta), and Bk (black) representing the respective colors are added after the numbers indicating components of the image formation units 1, in association with toner colors of images to be formed. In general descriptions, these symbols may be omitted.

In the printer 500, the four image formation units 1 (Y, M, C, Bk) have substantially the same configuration except for the toner colors to be used.

Figure 2:
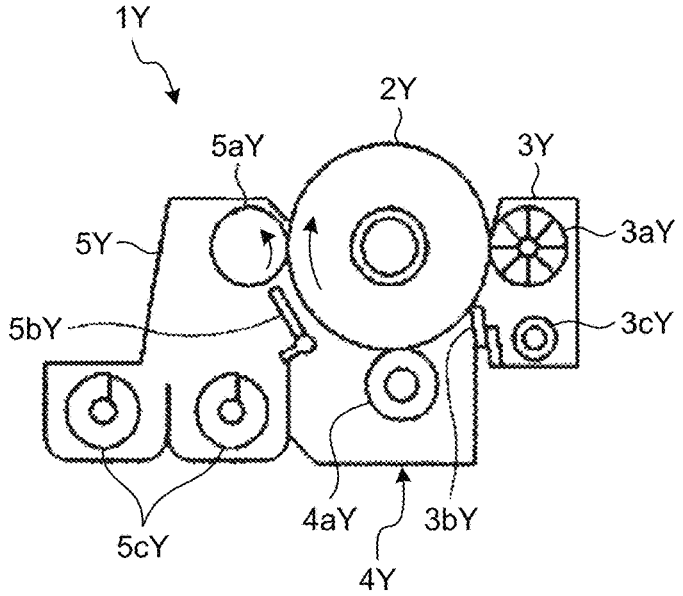
FIG. 2 is a schematic diagram for explaining an image formation unit for yellow among four image formation units.

FIG. 2 is a schematic diagram for explaining the image formation unit 1Y for yellow among the four image formation units 1 (Y, M, C, Bk).

As illustrated in FIG. 2, in the image formation unit 1Y, image formation members, such as a charging device 4Y, a developing device 5Y, and a cleaning device 3Y, are arranged in sequence around the photoconductor 2Y in accordance with an electrostatic photography process or the like. The charging device 4Y includes a charging roller 4*a*Y that faces the photoconductor 2Y, and the developing device 5Y includes a developing roller 5*a*Y, a developing brade 5*b*Y, screws 5*c*Y, and the like. Further, the cleaning device 3Y includes a cleaning brush 3*a*Y, a cleaning blade 3*b*Y, a recovery screw 3*c*Y, and the like.

As the photoconductor 2Y, for example, a layered structure in which an organic semiconductor layer that is a photoconductive substance is disposed on a surface of an aluminum cylinder with a diameter of about 30 to 120 millimeters (mm) may be used. Meanwhile, a belt type member may be used as the photoconductor.

As illustrated in FIG. 1, an exposure device 80 serving as a latent image formation means for scanning a surface of each of the photoconductors 2, which have been uniformly charged by the corresponding charging devices 4, with a laser beam 8 corresponding to image data of each of the colors is arranged below the photoconductors 2 (Y, C, M, Bk). An elongated space, in which the laser beam 8 emitted by the exposure device 80 enters toward the photoconductor 2, is ensured between each of the charging devices 4 and each of the developing devices 5 in a rotation axis direction of the photoconductor 2.

The exposure device 80 illustrated in FIG. 1 is an exposure device of a laser scan system using a laser light source, a polygon mirror, and the like, and the laser beams (Y, C, M, Bk) that are modulated in accordance with image data to be formed are emitted by four semiconductor lasers. The exposure device 80 has a metal or plastic housing in which optical components and control components are housed, and has a top surface on which translucent dust-resistant members are arranged at emission ports. While the printer 500 illustrated in FIG. 1 is constructed with the single housing, exposure devices are separately provide for the respective image formation units. Furthermore, an exposure device in which an LED array and an image forming means are combined, may be adopted instead of the exposure device using laser beams.

When color toners of yellow (Y), cyan (C), magenta (M), and black (Bk) are consumed by the developing devices 5 (Y, C, M, Bk) that handle the respective colors, the consumption is detected by a toner detection means. Then, toner supply means supply, to the developing devices 5, toner from four toner cartridges 40 (Y, C, M, Bk) that house toner of the respective colors and that are mounted in an upper part of the printer 500.

An outer cover of each of the toner cartridges 40 is a container made of resin, paper, or the like, includes an outlet in a part thereof, and is easily attached to and detached from an attaching portion 400 of the printer 500. When attached, the outlet is connected to the individual toner supply means that is arranged in a main body of the printer 500. Further, in the printer 500, an attaching error preventive means is arranged such that the attaching portions 400 and the toner cartridges have conjugated shapes to prevent a situation in which the toner cartridge 40 of each of the colors is erroneously attached and toner is supplied to the developing device that handles a different color.

In the developing device 5, as illustrated in the image formation unit 1Y for yellow as a representative in FIG. 2, the two screws 5*c*Y are arranged for stirring and conveying toner. When the developing device 5Y is attached to the printer 500, one end of the above-described toner supply means is connected to an upper part of the screw 5*c*Y on the left side in FIG. 2. The toner is supplied by the screw 5*c*Y to the developing roller 5*a*Y that rotates in a direction of arrow, and a thickness of a toner layer on the surface of the developing roller 5*a*Y is controlled by the developing blade 5*b*Y so as to reach a predetermined thickness.

The developing roller 5*a*Y is a cylinder made of stainless steel or aluminum, is rotatably supported by a frame of the developing device 5Y such that a distance with the photoconductor 2Y is maintained as normal, and includes an internal magnet such that predetermined magnetic field lines are formed. An electrostatic latent image of each of the colors formed with the laser beam 8 on the surface of each of the photoconductors 2 is developed by the developing device 5 that handles toner of a predetermined color, so that a developed image is formed.

An intermediate transfer unit 6 is arranged above the photoconductors 2 (Y, C, M, Bk). An intermediate transfer belt 6*a* serving as an image bearer that is extended around a plurality of rollers 6*b*, 6*c*, 6*d*, and 6*e* is arranged, and the intermediate transfer belt 6*a* runs in a direction of arrow along with rotation of the roller 6*b* to which drive is transmitted by a drive source. The intermediate transfer belt 6*a* has an endless shape and is extended so as to come in contact with the surface of each of the photoconductors 2 that have passed through portions facing the developing devices 5. Four primarily transfer rollers 7 (Y, C, M, K) are arranged in an inner peripheral portion of the belt so as to face the respective photoconductors 2.

A belt cleaning device 6*h* is arranged at a position facing the cleaning opposing roller 6*e* in an outer peripheral portion of the intermediate transfer belt 6*a*. The belt cleaning device 6*h* removes a foreign matter, such as unnecessary toner or paper powder, that remains on a surface of the intermediate transfer belt 6*a*. The cleaning opposing roller 6*e* failing the belt cleaning device 6*h* includes a mechanism that gives tension to the intermediate transfer belt 6*a*. The cleaning opposing roller 6*e* moves in order to constantly ensure appropriate belt tension, and the belt cleaning device 6*h* that faces the cleaning opposing roller 6*e* across the intermediate transfer belt 6*a* is also movable in an interlocked manner.

As the intermediate transfer belt 6*a*, for example, it is preferable to adopt a belt in which a resin film or rubber is used as a base substance and the base substance has a thickness of 50 to 600 micrometers (μm). The belt has a resistance value by which a toner image on each of the photoconductors 2 can be electrostatically transferred onto the belt surface with bias applied to each of the primary transfer rollers 7. Each of the components related to the intermediate transfer belt 6*a* included in the printer 500 is supported in an integrated manner with the intermediate transfer belt 6*a* so as to be constructed as the intermediate transfer unit 6, and can be attached to and detached from the printer 500.

As one example of the intermediate transfer belt, the intermediate transfer belt 6*a* is constructed by dispersing carbon in polyamide and adjusting resistance such that a volume resistance value reaches about $10^6$ to $10^{12}$ ohm centimeters (Ωcm). Further, a belt leaning preventive rib for stabilizing belt running is arranged on one end or both ends of the intermediate transfer belt 6*a*.

As one example of the primary transfer roller, each of the primary transfer rollers 7 of the printer 500 is constructed by coating a surface of a metal roller that is a cored bar with a conductive rubber material, and bias is applied from a power source to a cored bar portion. The conductive rubber material is constructed by dispersing carbon in urethane rubber, and resistance is adjusted such that volume resistance reaches about 105 (Ωcm). Meanwhile, a metal roller without a rubber layer may be adopted as the primary transfer roller. A secondary transfer roller 14*a* is arranged at a position facing the secondary transfer opposing roller 6*b* across the intermediate transfer belt 6*a* is arranged on an outer periphery of the intermediate transfer belt 6*a*. The secondary transfer roller 14*a* is constructed by coating a surface of a metal roller that is a cored bar with conductive rubber, and bias is applied from a power source 14*b* to a cored bar portion. Carbon is dispersed in the above-described conductive rubber, and resistance is adjusted such that volume resistance reaches about 107 (Ωcm).

The secondary transfer roller 14*a* comes in contact with the intermediate transfer belt 6*a* at a position facing the secondary transfer opposing roller 6*b*, so that a secondary transfer nip as a secondary transfer portion is formed. In the secondary transfer nip, bias is applied while causing a transfer sheet S (sheet of paper) that is a recording medium to pass through a space between the intermediate transfer belt 6*a* and the secondary transfer roller 14*a*, so that the toner image on the intermediate transfer belt 6*a* is electrostatically transferred onto the transfer sheet S.

Multiple-stage sheet cassettes, such as two-stage sheet cassettes 9A and 9B, are arranged in a drawable manner in the sheet feed unit 300 that is disposed below the exposure device 80. The transfer sheets S stored in the sheet cassettes are selectively fed along with rotation of corresponding calling rollers 10A and 10B, and fed to a sheet feed path P1 by separation rollers 11A and 11B and conveying roller pairs 12A and 12B.

On the sheet feed path P1, a timing roller pair 13 formed of a pair of rollers is arranged to control a feed timing at which the transfer sheet S is fed to the secondary transfer portion. The transfer sheet S is conveyed from the timing roller pair 13 toward the secondary transfer nip that is formed by the intermediate transfer belt 6*a* and the secondary transfer roller 14*a*.

The printer 500 includes a manual sheet feeding tray 25 serving as a manual sheet feed unit on the right side in FIG. 1. When not used, the manual sheet feeding tray 25 can be rotated and housed in a side frame F that is a part of the main body of the printer 500. The topmost transfer sheet S stored in the manual sheet feeding tray 25 is fed by a manual calling roller 26. Then, the transfer sheet S is separated by a reverse roller 27 serving as a separation means such that only a single sheet is reliably conveyed and fed to the timing roller pair 13 by a pair of conveying rollers 22 and 24 via the sheet feed path P1.

A fixing device 15 that includes a heating means is arranged above the secondary transfer nip. The fixing device 15 included in the printer 500 includes a fixing roller 15*a* having a built-in heater and a pressurizing roller 15*b* that comes in pressure contact with the fixing roller 15*a*. The fixing device need not always be configured as described above, and a device using a belt or a device using an induction heater (IH) as a heating system may be adopted appropriately.

A switching guide 63 is rotatable, and in the state as illustrated in the figure, the transfer sheet S for which fixing is completed is guided to a guide member 61*a* that constitutes a paper ejection path. The transfer sheet S guided to the guide member 61*a* is ejected along with rotation of a discharge roller 62 as indicated by an arrow D in FIG. 1, and stacked on a discharge tray 60 in an upper part of the printer 500.

The printer 500 illustrated in FIG. 1 includes a duplex unit that includes a sheet re-feed path and a roller for reversing and re-feeding the transfer sheet S so as to automatically form images on both sides of the transfer sheet S. Specifically, a switchback path P5 and a sheet re-feed path P6 are arranged inside the side frame F, and the switching guide 63, a second switching guide G2, and a third switching guide G3 are arranged to convey, to the sheet feed path P1, the transfer sheet S for which image formation on one side is completed.

Further, a reverse roller 18*a*, the reverse roller pair 22, and the like that can rotate in a reverse direction by connection to a drive source and control of the drive source are arranged. A roller 23 and the roller 24 are in contact with the reverse roller pair 22. The reverse roller pair 22 rotates in a clockwise direction to convey a sheet from the manual sheet feeding tray 25 in cooperation with the roller 24. Further, the reverse roller pair 22 rotates in a counterclockwise direction to feed the transfer sheet S located in the sheet re-feed path P6 again in a direction toward the timing roller pair 13 in cooperation with the roller 23.

When the switching guide 63 rotates in the clockwise direction from the state as illustrated in the figure, the transfer sheet S for which fixing is completed is guided to a reverse conveying path P4 by a roller pair 17, conveyed to a reverse roller pair 18 via the second switching guide G2, and temporarily conveyed to the switchback path P5. After the transfer sheet S is conveyed to the switchback path P5, the reverse roller 18*a* of the reverse roller pair 18 rotates in the counterclockwise direction and the second switching guide G2 rotates in the counterclockwise direction, so that the transfer sheet S is conveyed from the switchback path P5 to the sheet re-feed path P6. In the sheet re-feed path P6, the transfer sheet S conveyed by a pair of rollers 15*c* and 20 and a pair of rollers 14*c* and 21 is further conveyed to the pair of rollers 22 and 23 and reaches the timing roller pair 13.

In the printer 500 illustrated in FIG. 1, a sheet feed device 50 that is an additional sheet feed unit is arranged below the sheet feed unit 300. In the sheet feed device 50 illustrated in FIG. 1, two sheet cassettes 9C and 9D are arranged, but a type including a larger number of sheet cassetes and a type with a built-in sheet cassete capable of housing a larger number of sheets may be adopted.

In the printer 500, the third switching guide G3 located on the downstream side of the roller pair 17 in the conveying direction above the fixing device 15 can rotate in the counterclockwise direction from the state illustrated in FIG. 1 to guide the transfer sheet S for which fixing is completed to a paper ejection path P8 and discharge the transfer sheet S to a different paper ejection device. Examples of the different paper ejection device include a bin tray including a several-stage discharge tray.

Next, operation of the printer 500 for performing one-side printing to form an image on one side of the transfer sheet S will be described.

First, the surface of the photoconductor 2Y that is uniformly charged by the charging roller 4*a*Y is irradiated with the laser beam 8Y that is emitted by the semiconductor laser by operation of the exposure device 80 and that corresponds to yellow image data, so that an electrostatic latent image is formed. The electrostatic latent image is developed into a visible image with yellow toner through a developing process performed by the developing roller 5*a*Y, and is primarily transferred through transfer operation performed by the primary transfer roller 7Y onto the surface of the intermediate transfer belt 6*a* that moves in synchronization with the photoconductor 2Y. The latent image formation, the development, and the primary transfer operation as described above are sequentially performed in the same manner at appropriate timings in the other photoconductors 2 (C, M, Bk).

As a result, a four-color toner image, in which color toner images of yellow Y, cyan C, magenta M, and black Bk are sequentially superimposed on one another, is carried on the surface of the intermediate transfer belt 6*a*, and is conveyed together with the intermediate transfer belt 6*a* that performs surface movement in the direction of arrow. Meanwhile, the surface of the photoconductor 2 that has passed through positions facing the primary transfer roller 7 across the intermediate transfer belt 6*a* is cleaned by the cleaning device 3 to remove remaining toner and foreign matters.

The four-color toner image formed on the intermediate transfer belt 6*a* is transferred, by a transfer action of the secondary transfer roller 14*a*, onto the transfer sheet S that is conveyed in synchronization with the intermediate transfer belt 6*a*. Then, the surface of the intermediate transfer belt 6*a* is cleaned by the belt cleaning device 6*h* for preparation for a next image formation and transfer process. The transfer sheet S on which the image is transferred receives a fixing action of the fixing device 15, and ejected onto the discharge tray 60 by the discharge roller 62 with the image-formed side facing down.

Next, operation of the printer 500 for performing duplex printing to form images on both sides of the transfer sheet S will be described.

By the same actions in the one-side printing as described above, the transfer sheet S, for which the image has been transferred from the intermediate transfer belt 6*a* on one side and which has passed through the fixing device 15, is guided toward the roller pair 17 by the switching guide 63. The transfer sheet S that moves to the upper side of the second switching guide G2 located at a rotation position in FIG. 1 through the third switching guide G3 and the reverse conveying path P4 that are located on the downstream side of the roller pair 17 in the conveying direction is further conveyed to the switchback path P5 by the reverse roller pair 18.

In this case, the reverse roller 18*a* rotates in the clockwise direction. A roller pair 19 in the switchback path P5 is a roller pair that can rotate in both of a forward direction and a reverse direction, and is driven to rotate in the reverse direction after the transfer sheet S is temporarily received in the switchback path P5, to thereby convey the transfer sheet S in the reverse direction. When the rotation directions of the roller pair 19 and the reverse roller pair 18 are reversed, the second switching guide G2 rotates in the counterclockwise direction from the posture as illustrated in FIG. 1.

Then, the transfer sheet S is conveyed in the sheet re-feed path P6 by the pair of rollers 15*c* and 20 and the pair of rollers 14*c* and 21 and conveyed toward the sheet feed path P1 to reach the timing roller pair 13 such that an end of the transfer sheet S that has served as the trailing end until the transfer sheet S enters the switchback path P5 serves as the leading end. Thereafter, the timing roller pair 13 controls a timing to re-convey the transfer sheet S that carries the image on one side to the secondary transfer nip in which the secondary transfer roller 14*a* and the intermediate transfer belt 6*a* face each other, and the toner image on the intermediate transfer belt 6*a* is transferred on the other side of the transfer sheet S.

An image to be formed on the second surface of the transfer sheet S is sequentially formed through the image formation the process that is started when the transfer sheet S is conveyed to a predetermined position. The image formation process in this case is the same as the full-color toner image formation performed in the one-side printing as described above, and a full-color toner image is carried on the intermediate transfer belt 6*a*. However, because the leading end and the trailing end of the transfer sheet S are reversed in the conveying path, generation of image data to be output from the exposure device 80 is controlled such that the image formation is performed in a reverse order in the sheet conveyance direction as compared to the initial image formation.

The transfer sheet S for which the full-color toner images are transferred on both sides is ejected, by the discharge roller 62, onto the discharge tray 60 again through the fixing process performed by the fixing device 15. Meanwhile, in the printer 500, it is possible to simultaneously convey the plurality of transfer sheets S in the conveying paths in order to improve efficiency of the duplex image formation. Further, timings to form images on the front side and the back side of the transfer sheet S are controlled by a control means.

Furthermore, in the printer 500, a polarity of the toner image formed on the photoconductor 2 is negative, and by applying a positive charge to the primary transfer roller 7, the toner image on the photoconductor 2 is transferred onto the surface of the intermediate transfer belt 6*a*. Moreover, by applying a positive charge to the secondary transfer roller 14*a*, the toner image on the surface of the intermediate transfer belt 6*a* is transferred onto the transfer sheet S.

While the example has been described in which full-color printing is performed in the one-side printing operation and the duplex printing operation, some photoconductors are not used in monochrome printing using black. A mechanism is arranged that suspends operation of the non-used photoconductors 2 (Y, M, C) and the non-used developing devices 5 (Y, M, C), and maintains a non-contact state between the non-used photoconductors 2 (Y, M, C) and the intermediate transfer belt 6*a*. In the printer 500, an inner frame 6*f* that supports the roller 6*d* and the primary transfer rollers 7Y, 7C, and 7M is supported so as to be able to rotate around a frame shaft 6*g*.

At the time of monochrome printing, by rotating the inner frame 6*f* in a direction away the photoconductors 2 (Y, M, C) (in the clockwise direction in FIG. 1), only the photoconductor 2K comes in contact with the intermediate transfer belt 6*a* and performs the image formation process, so that a monochrome image is formed with black toner. In this manner, operation of separating the non-used photoconductors 2 (Y, M, C) of the image formation units 1 (Y, M, C) from the intermediate transfer belt 6*a* and suspending the photoconductors 2 (Y, M, C) and the developing devices 5 (Y, M, C) in the monochrome printing is advantageous to improve the lifetime of the image formation unit 1 (Y, M, C).

In the printer 500, if it is necessary to perform maintenance or replacement of components, an outer cover or the like is opened and maintenance etc. is performed. At the time of maintenance, it is possible to improve operability if the components included in the image formation unit 1 as illustrated in FIG. 1 are integrally supported and replaced as a process cartridge unit.

Furthermore, if the image formation unit 1 as illustrated in FIG. 1 is configured as the process cartridge, a guide unit or a handle used for attachment to the printer 500 is arranged to make the attachment and detachment easy. In addition, if a storage device (for example, an integrated circuit (IC) tag) for storing characteristics or operating conditions of the process cartridge is arranged, it is possible to use them as a guideline for the maintenance, so that it is possible to improve convenience for maintenance and management of the process cartridge.

Moreover, if maintenance, replacement, or the like of the intermediate transfer unit 6 is to be performed, the configuration where the intermediate transfer belt 6*a* and each of the photoconductors 2 are separated to extract the intermediate transfer unit 6 from the main body of the printer 500, may be adopted.

Figure 3:
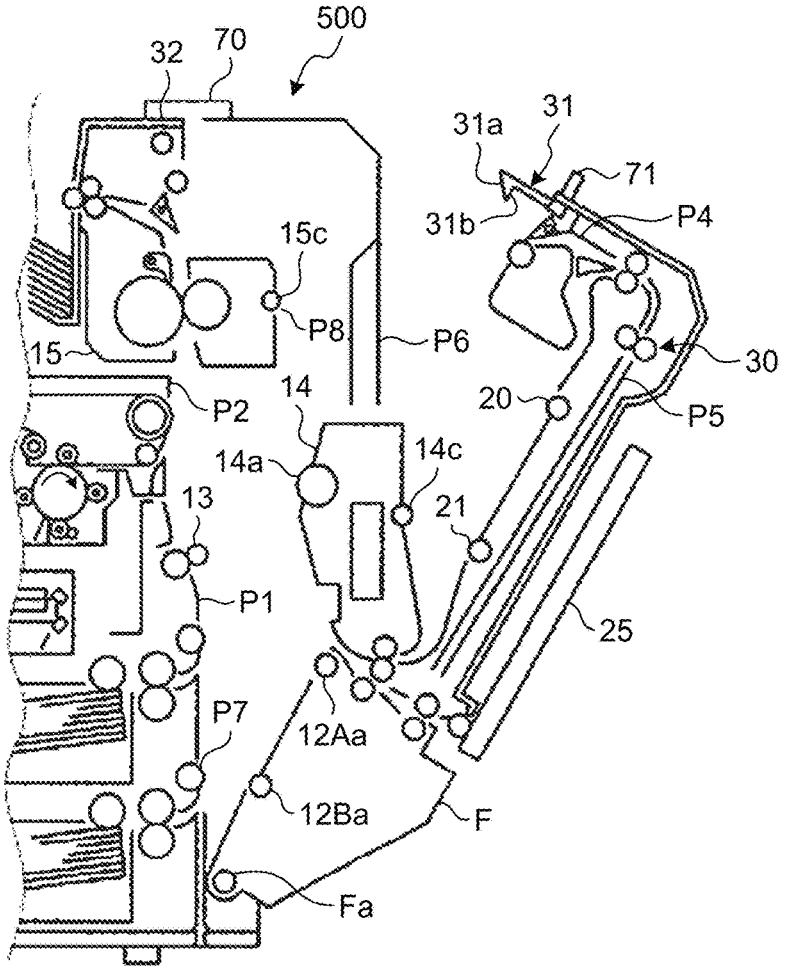
FIG. 3 is a diagram for explaining a vicinity of a side frame when the side frame is opened from the printer in the state in FIG. 1.

FIG. 3 is a diagram for explaining the vicinity of the side frame F when the side frame F is opened from the printer 500 in the state as illustrated in FIG. 1. The side frame F includes a duplex unit 30 and the secondary transfer unit 14, is rotatable with respect to the printer 500 about a rotation axis Fa located in the lower side, and is configured such that an upper part is openable as illustrated in FIG. 3 when the side fame F is rotated in the state as illustrated in FIG. 1.

Furthermore, an engaging protrusion 71 that is an engaged member is arranged on a top surface of the side frame F. When the side frame F is moved in a closing direction to attach the secondary transfer unit 14 and the duplex unit 30 to the printer 500, the engaging protrusion 71 engages with an engaging portion of a retracting device 70 that is arranged in the upper part of the printer 500. When the engaging protrusion 71 serving as the engaged member of the side frame F engages with the engaging portion of the retracting device 70, the retracting device 70 retracts the side frame F toward the printer 500 side.

When the frame is retracted by the retracting device 70, a guide unit 31*a* of a stopper member 31 comes in contact with a blocking member 32. Then, the stopper member 31 is rotated by a retracting force of the retracting device 70 and moves across the blocking member 32, so that the side frame F is closed and the secondary transfer unit 14 and the duplex unit 30 are attached to the attachment position.

Before the side frame F is opened, the stopper member 31 arranged on the side frame F is rotated by operation of a lock lever to release the stopper member 31 from the blocking member 32 arranged on the printer 500 side and disable a stopper function, so that the side frame is opened. As illustrated in FIG. 3, it is possible to open the plurality of conveying paths (P1, P2, P6) by opening the side frame F, so that it is possible to easily cope with the transfer sheet S that is jammed in the conveying paths.

The secondary transfer unit 14 in which an after-transfer conveying path P2 and the switchback path P5 are formed on both surfaces of a housing rotates about the center of the roller 23, and when the side frame F is opened as illustrated in FIG. 3, the secondary transfer roller 14*a* is separated from the intermediate transfer belt 6*a*. Furthermore, the secondary transfer unit 14 has a rotation behavior to separate the roller 14*c* from the roller 21. The secondary transfer unit 14 is a unit that includes, inside thereof, the power source 14*b*, and is provided with, on a case exterior thereof, a function to convey the transfer sheet S.

The fixing device 15 includes the conveying roller pair 15*c* and a conveying guide surface, and a part thereof constitutes the sheet re-feed path P6. The fixing device 15 is supported so as to be extracted toward the right side in the figure in the state as illustrated in FIG. 3. Therefore, it is possible to easily cope with a paper jam that occurs inside the fixing device 15.

The conveying roller pair 15*c* is biased toward the roller 20 side by a spring, and the conveying roller 14*c* is biased toward the roller 21 side by a spring. Furthermore, rollers on the printer 500 side in the conveying roller pairs 12A and 12B are biased, by springs, toward rollers 12Aa and 12Ba that are located on the side frame F side in the conveying roller pairs 12A and 12B.

As a result, when the side frame F is located at a closed position in FIG. 1, the side frame F is biased in an opening direction by the conveying roller pair 15*c*, the conveying roller 14*c*, and the rollers on the printer 500 side in the conveying roller pairs 12A and 12B. Consequently, a stopper surface 31*b* of the stopper member 31 comes in contact with the blocking member 32 and the position of the side frame F is determined.

While the printer 500 as the image forming apparatus has been described above, a sheef feed device used in the printer 500 will be described in detail below.

As a sheet feed system of the sheet feed device as described above, an FRR sheet feed system and an RF sheet feed system are known. In the FRR system (feed and reverse roller system), reverse torque is applied to a separation roller serving as a separation member in order to feed sheets one by one. In the RF system (roller friction system), reverse torque is not applied to the separation roller.

Figure 4:
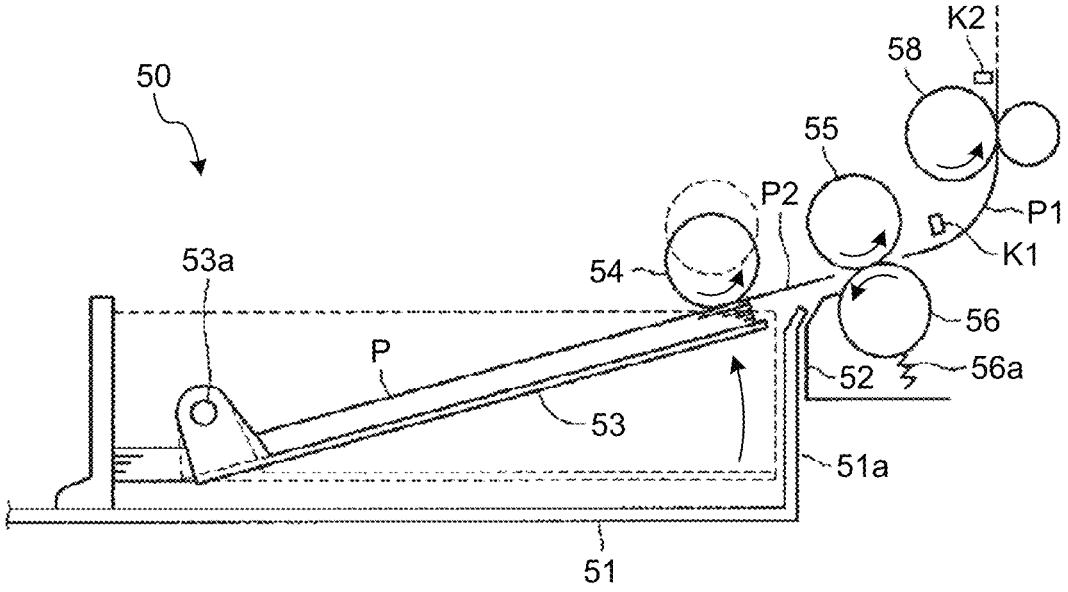
FIG. 4 illustrates an example of a sheet feed mechanism of an FRR system.

FIG. 4 illustrates an example of a sheet feed mechanism of the FRR system. In FIG. 4, 51 denotes a sheet feed tray, 52 denotes a sheet guide, 53 denotes a bottom plate, 54 denotes a calling roller, 55 denotes a feed roller, 56 denotes a separation roller, 58 denotes a grip roller, K1 denotes a leading end detection means, K2 denotes a sheet detection means, P denotes a sheet bundle, P1 denotes a preceding sheet, and P2 denotes a subsequent sheet.

The FRR system includes the feed roller 55 and the separation roller 56 that is pressed against the feed roller 55. The feed roller 55 rotates in a sheet feed direction and the separation roller 56 receives a driving force (reverse torque) in a direction opposite to the feed direction via a torque limiter. The FRR system has higher separation performance than the RF system because reverse torque is applied. Both of the systems are advantageous in that the sheet separation performance is not affected even when a positional relationship between the position of the leading end of the sheet and a pressure portion (feed nip) of the feed roller 55 and the separation roller 56 is rough. Therefore, the sheet feed systems require no extra cost to improve positional accuracy, and are preferably applied to a front-loading type sheet feed tray that is a mainstream type of recent years.

In sheet feed devices of the FRR system and the RF system, in general, a sheet is called from a sheet bundle along with rotation of the calling roller 54 that is gear-coupled with the feed roller 55. The calling roller 54 comes in contact with the topmost sheet of the sheet bundle P, and feeds the sheet (the preceding sheet P1) to the downstream side in the conveying direction. Then, the preceding sheet P1 that is fed as described above is conveyed to the downstream side in the conveying direction by the feed roller 55 that is located on the downstream side of the sheet feed tray 51. Even before the trailing end of the preceding sheet P1 passes through the contact point of the calling roller 54, if the leading end of the preceding sheet P1 reaches the grip roller 58 that is arranged on the downstream side, the calling roller 54 is separated from the sheet surface of the preceding sheet (or caused to stop driving). Then, if the leading end of the preceding sheet P1 is detected by the sheet detection means K2 that is located on the downstream side of the grip roller 58, the calling roller 54 is triggered by the sheet detection and comes in contact with a sheet surface of the topmost sheet (the subsequent sheet P2) on the sheet feed tray 51 (or driven again) in order to feed the subsequent sheet P2.

In contrast, to prevent a sheet jam, drive of the feed roller 55 is stopped before the trailing end of the preceding sheet P1 passes through the feed nip. A one-way clutch is connected to a rotary shaft of the feed roller 55, so that even when the drive of the feed roller 55 is stopped, the feed roller 55 itself is rotated (driven to rotate) in a synchronous manner in the conveying direction of the sheet that is conveyed by the grip roller 58. Because the drive of the feed roller 55 is stopped and the separation roller 56 rotates in the reverse direction, even when the leading end of the subsequent sheet P2 reaches the feed nip following the trailing end of the preceding sheet P1, it is possible to reliably separate the sheets and prevent occurrence of a sheet jam due to a failure to control a sheet interval between the preceding sheet P1 and the subsequent sheet P2.

A start timing of the subsequent sheet P2 is triggered by detection of the leading end of the preceding sheet P1 by the sheet detection means K2 that is arranged on the downstream side of the grip roller 58 where a behavior of the sheet becomes stable (a slip ratio is reduced). In response to the trigger, drive of the calling roller 54 and the feed roller 55 is started at a predetermined timing at which collision with the trailing end of the preceding sheet P1 does not occur and predetermined productivity can be achieved.

Meanwhile, in copiers and printers of recent years, it is necessary to reduce a sheet speed at the time of image formation in order to realize high image quality and low power consumption, but it is also demanded to increase a printing speed (high pinring productivity). Therefore, by reducing the sheet speed while reducing the sheet interval in the sheet feed unit, the high image quality and the high printing productivity are to be simultaneously realized.

The FRR system and the RF system are advantageous in terms of costs and preferable for a front-loading type as described above. However, the FRR system and the RF system of the conventional technique feed the subsequent sheet P2 in the sheet feed tray 51 by being triggered by the detection of the leading end of the preceding sheet P1 by the leading end detection means as described above; therefore, the sheet interval between the preceding sheet P1 and the subsequent sheet P2 are relatively long.

Meanwhile, a distance from a leading end position of a sheet stacking portion of the sheet feed tray 51 to the feed nip of the feed roller 55 varies in a range of 15 milimeters (mm) to 30 mm because of a front wall 51*a* of the sheet feed tray 51, the sheet guide 52, and backward movement of the leading end of the sheet bundle due to elevation of the bottom plate 53 of the sheet cassette when the number of stacked sheets is small. Therefore, a start position is largely changed depending on whether synchronous feeding by friction occurs between the preceding sheet P1 and the subsequent sheet P2. In other words, if synchronous feeding by friction occurs, the subsequent sheet P2 that is synchronously fed by friction with the preceding sheet P1 may already reach the feed roller 55 at the time of starting the subsequent sheet P2.

The start timing of the subsequent sheet P2 needs to be determined at a delayed timing at which the sheet that has been synchronously fed to the position of the feed roller 55 located at the most leading end position does not colide with the trailing end of the preceding sheet P1. To cope with this, an actual sheet interval between the subsequent sheet P2 that is started from the sheet feed tray 51 located at the most trailing end position and the preceding sheet P1 is increased by about 30 mm at a maximum relative to a target sheet interval, which may inhibit improvement in the printing speed.

Figure 5:
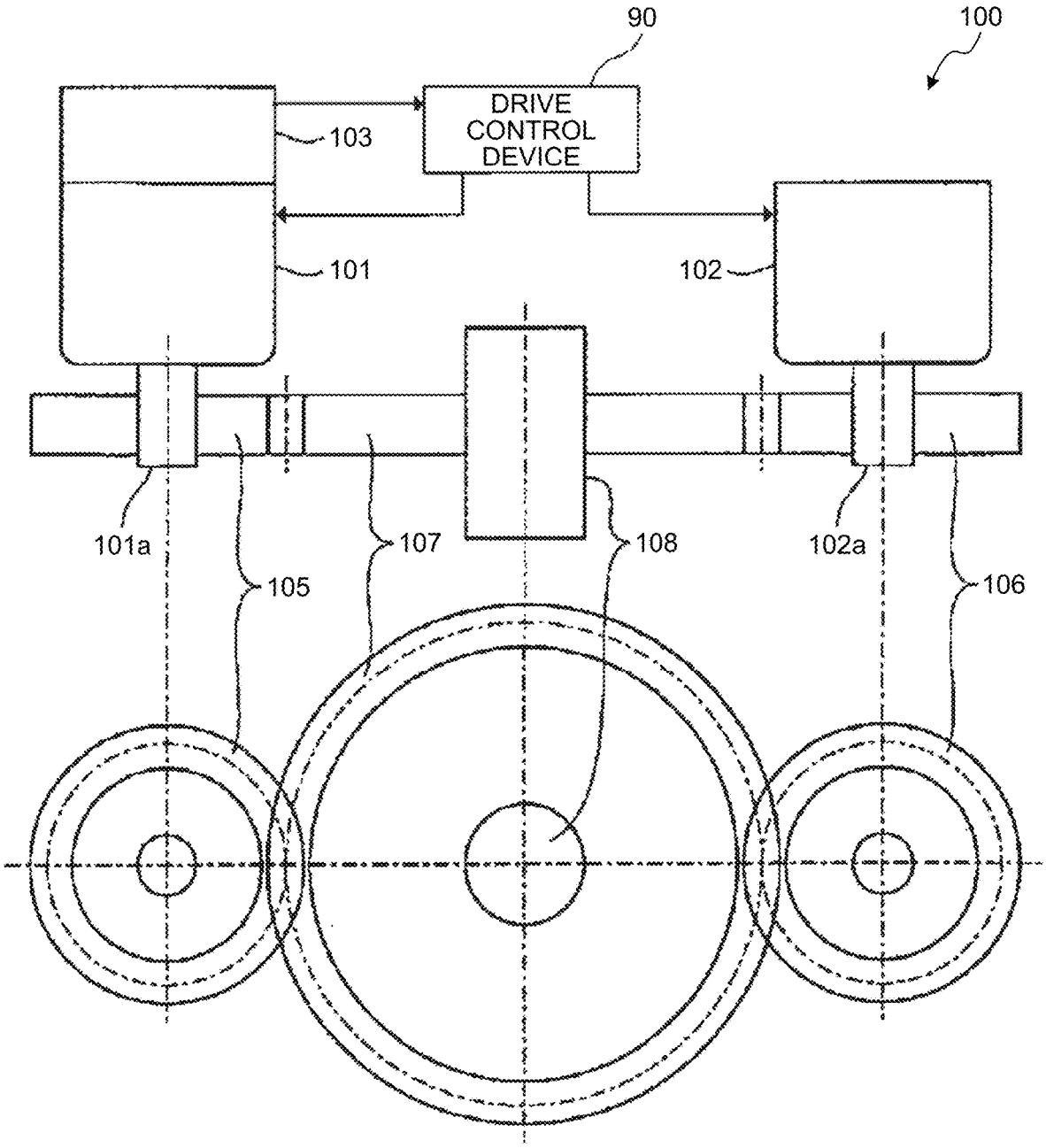
FIG. 5 is a diagram illustrating a driving device that drives a feed roller.

Therefore, in view of the above-described circumstances, a sheet feed device in which the sheet leading end detection means K1 is arranged on the downstream side of the feed roller 55 and the subsequent sheet P2 is conveyed at an increased conveying speed to the leading end detection means K1 has been proposed (see FIG. 5 in Japanese Laid-open Patent Publication No. 2005-213039).

In the sheet feed device as described above, after the trailing end of the preceding sheet P1 passes by the leading end detection means K1, and if the leading end detection means K1 detects the sheet leading end of the subsequent sheet P2, it is determined whether a minimum sheet interval 5 that is detectable by the sheet detection means K2 is ensured between the preceding sheet P1 and the subsequent sheet P2. In other words, the sheet interval 5 is calculated from a time at which the sheet detection means K2 detects the leading end of the preceding sheet P1, a length of the preceding sheet P1, and a time at which the leading end detection means K1 detects the leading end of the subsequent sheet P2. Then, a conveying state of the feed roller 55 is controlled such that the minimum sheet interval 5 is formed when the leading end of the subsequent sheet P2 reaches the sheet detection means K2 located on the downstream side of the grip roller 58. Further, if the leading end of the preceding sheet P1 does not reach the sheet detection means K2 when the leading end detection means K1 detects the leading end of the subsequent sheet P2, conveyance of the subsequent sheet P2 is temporarily stopped and the start position of the subsequent sheet P2 is determined.

However, if the feeding of the subsequent sheet P2 is temporarily suspended, a time loss due to the suspension occurs. Further, to compensate for the time loss, it is necessary to extremely increase the speed when feeding is resumed at a later timing, and a large-scale stepping motor is needed in each of the feed roller 55 and the grip roller 58 to cope with the increased speed, which results in the increased costs.

In the present embodiment, two motors for driving the feed roller 55 are provided, and by driving the feed roller 55 by the two motors, it is possible to prevent an increase in size and costs.

FIG. 5 is a diagram illustrating a driving device 100 that drives the feed roller 55 that is a sheet feed-conveying roller.

As illustrated in FIG. 5, the driving device 100 includes a first motor 101 serving as a drive source and a second motor 102 serving as a drive source with the same torque as the first motor 101. A first gear 105 that is press-fitted in a motor shaft 101*a* of the first motor 101 engages with an output gear 107, and a second gear 106 that is press-fitted in a motor shaft 102*a* of the second motor 102 and that has the same shape as the first gear 105 engages with the output gear 107. The first gear 105 and the second gear 106 engage with the output gear 107 that is arranged on a shaft 108 of the feed roller 55 as an output shaft and that has a large number of teeth.

A driving force of the first motor 101 is transmitted to the shaft 108 of the feed roller 55 while rotation motion is decelerated by the first gear 105 and the output gear 107. A driving force of the second motor 102 is transmitted to the shaft 108 of the feed roller 55 while rotation motion is decelerated by the second gear 106 and the output gear 107. Accordingly, the feed roller 55 is rotated by the driving forces of the first motor 101 and the second motor 102. In this manner, by driving the feed roller 55 by using the two motors, it is possible to generate large driving torque and cope with the increased speed. Furthermore, it is possible to cope with the increased speed at low costs as compared to a case in which a single high-power motor is used to cope with the increased speed.

Moreover, an encoder 103 for detecting a shaft angle of the motor shaft 101*a* is mounted coaxially with the motor shaft 101*a* of the first motor 101. Shaft angle information detected by the encoder 103 is transmitted to a drive control device 90 that controls drive of the first motor 101 and the second motor 102. The drive control device 90 controls drive of the two motors by performing feedback control using output information of the encoder 103. Meanwhile, a means for detecting the shaft angle is not limited to the encoder, but any means, such as a potentiometer, capable of detecting the shaft angle of the motor is applicable.

Figure 6:
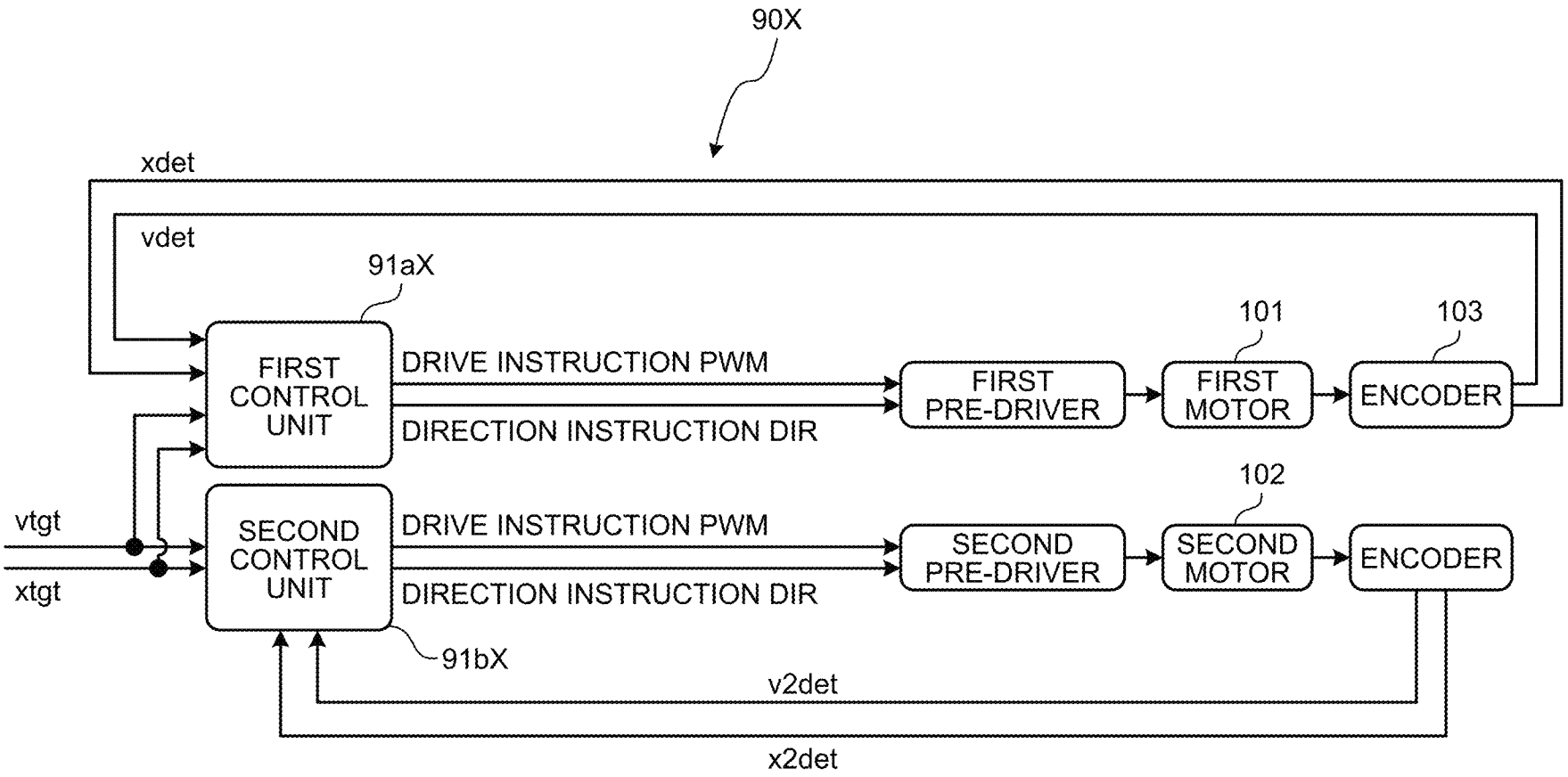
FIG. 6 is a block diagram illustrating an example of a conventional drive control device.

FIG. 6 is a block diagram illustrating an example of a conventional drive control device 90X.

The conventional drive control device 90X (a drive control device described in Japanese Laid-open Patent Publication No. 2017-151528) includes a first control unit 91*a*X that controls the drive of the first motor 101 and a second control unit 91*b*X that controls the drive of the second motor 102. Each of the control units performs proportional-integral-derivative (PID) control that is a type of feedback control.

The first control unit 91*a*X performs feedback of a positional signal x1det and an angular velocity v1det that are obtained from the encoder 103 that detects the shaft angle of the motor shaft 101*a* of the first motor 101, and obtains deviations from a position target value xtgt and an angular velocity vtgt. Then, a current value or a voltage value as a drive control signal for driving the first motor 101 is output based on the deviations. The second control unit 91*b*X performs feedback of a positional signal x2det and an angular velocity v2det that are obtained from an encoder 104 that detects a shaft angle of the motor shaft 102*a* of the second motor 102, and obtains deviations from the position target value xtgt and the angular velocity vtgt. Then, a current value or a voltage value as a drive control signal for driving the second motor 102 is output based on the deviations.

Meanwhile, the conventional drive control device 90X as illustrated in FIG. 6 includes a control unit that performs PID control for each of the motors, and therefore, it is possible to perform different detailed operation for each of the motors (for example, operation of slightly shifting positions, as offset, of the first motor 101 and the second motor 102 and performing backlash correction at the time of stoppage). On the other hand, it is necessary to arrange a means, such as an encoder, for detecting the shaft angle for performing PID control for each of the motors, a control circuit and a control substrate for performing the PID control, and the like, so that costs and a device size may be increased due to an increase in the number of components. Furthermore, it is disadvantageous that a hardware configuration and a control method become complicated.

Therefore, in the present embodiment, a single PID control unit controls drive of a plurality of motors using a single drive control signal (a voltage value or a current value). With this configuration, it is possible to control drive by a plurality of drive sources on the basis of a signal obtained from a common encoder, and it is possible to integrate a control circuit and a control substrate for performing the PID control into a single device, so that it is possible to reduce a device size and a device cost. Consequently, the present embodiment is preferably applied to a device in which priority is given to reduction of costs and a device size rather than functionalities. However, when a single control unit controls drive of a plurality of motors, it is difficult to detect a failure of each of the motors, which is a disadvantage.

This is because the plurality of drive sources use the common encoder, and even if any of the motors stops driving due to a failure, other motors are rotated and the encoder continues to output appropriate angular velocity information. Consequently, when any of the motors has failed, it is difficult to detect the failure.

To cope with this, the present embodiment is configured to allow only one of the motors to drive to check a failure of the motor (whether the drive is stopped or unstable).

Figure 7:
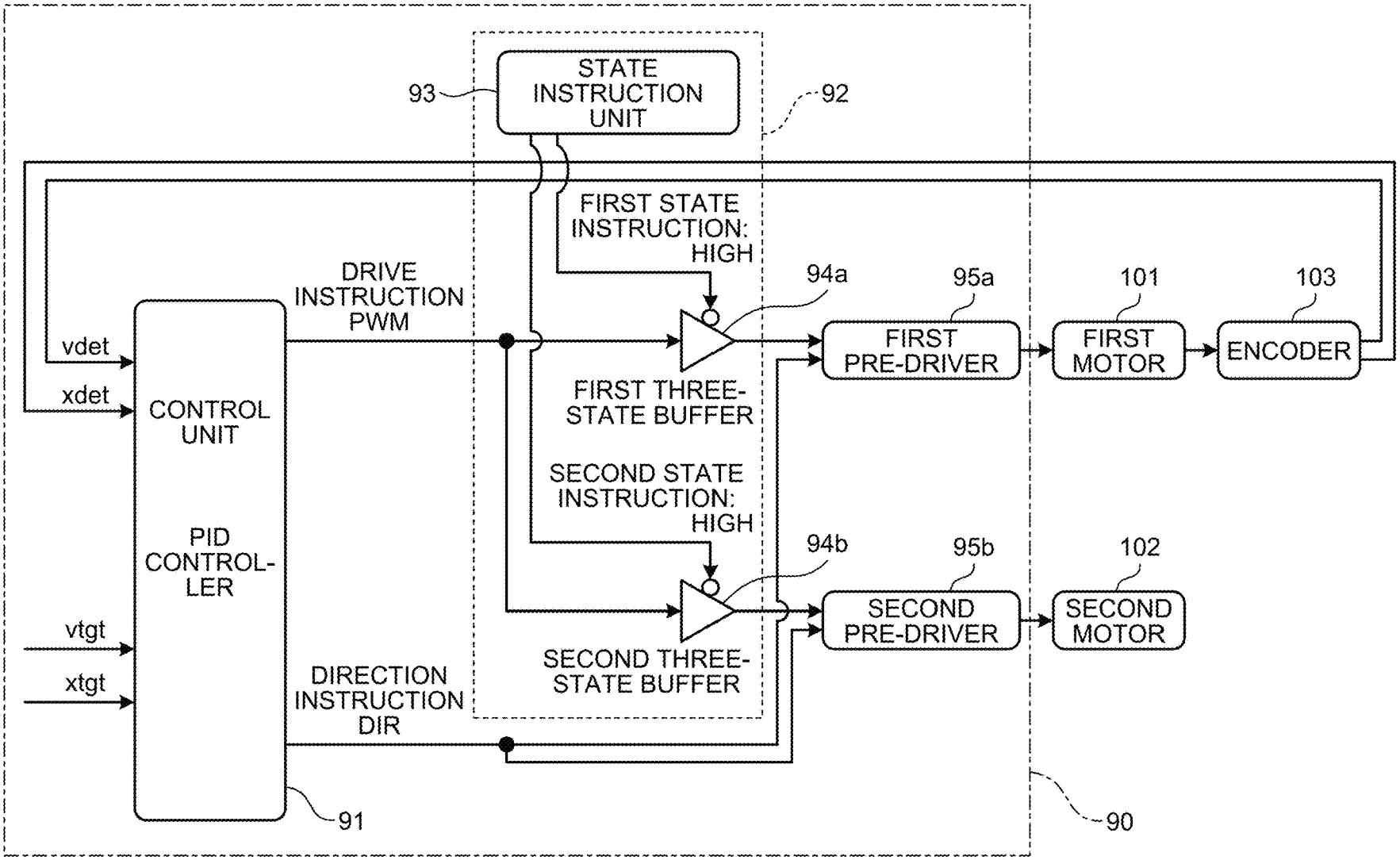
FIG. 7 is a block diagram of a drive control device of the embodiment.

FIG. 7 is a block diagram of the drive control device 90 of the present embodiment.

As illustrated in FIG. 7, the drive control device 90 of the present embodiment includes a control unit 91 shared by the motors 101 and 102 that perform the PID control, a mode switch unit 92 that switches among a first mode for driving the first motor 101 and the second motor 102, a second mode for driving only the first motor 101, and a third mode for driving only the second motor 102. The mode switch unit 92 includes a first three-state buffer 94*a* as a signal blocking means that is arranged in a drive control signal transmission line between the control unit 91 and a first pre-driver 95*a* that drives the first motor 101, a second three-state buffer 94*b* as a signal blocking means that is arranged in a drive control signal transmission line between the control unit 91 and a second pre-driver 95*b* that drives the second motor 102, and a state instruction unit 93 that transmits a state instruction signal to each of the three-state buffers 94*a* and 94*b*.

The state instruction unit 93 outputs a state instruction signal of High or Low to each of the three-state buffers 94*a* and 94*b*. Each of the three-state buffers 94*a* and 94*b* blocks the drive control signal transmitted from the control unit 91 while the state instruction signal of Low is input, and transmits the drive control signal transmitted from the control unit 91 to the pre-driver while the state instruction signal of High is input.

FIG. 7 illustrates an example of the first mode in which the first motor 101 and the second motor 102 are driven and the state instruction signal of High is input to each of the three-state buffers 94*a* and 94*b*.

The control unit 91 performs feedback of the positional signal xdet and the angular velocity vdet obtained from the encoder 103 that detects the shaft angle of the motor shaft

101*a*, and obtains deviations from the position target value xtgt and the angular velocity vtgt. Then, a drive instruction signal (PWM signal) or a direction instruction signal (DIR signal) as a common drive control signal shared by the motors is generated based on the deviations, and transmitted to each of the motors 101 and 102. Meanwhile, in the present embodiment, the PWM signal is used as the drive instruction signal, but the drive instruction signal may be a current value, a voltage value, or a combination of the current value and the voltage value.

In the first mode that is set at the time of feeding as normal operation, the state instruction signal of High is input to each of the three-state buffers 94*a* and 94*b*. Therefore, the drive instruction signal (PWM) as the drive control signal transmitted from the control unit to each of the motors 101 and 102 is transferred to the pre-drivers 95*a* and 95*b*. Therefore, the first motor 101 and the second motor 102 drive and the feed roller 55 is driven by the first motor 101 and the second motor 102.

As described above, in the first mode, a large driving force is obtained because the first motor 101 and the second motor 102 are driven. Further, with use of single position negative feedback using the single control unit 91, it is possible to obtain a large driving force with a simple and low-cost configuration.

However, in the present embodiment, because only the single drive control signal and the negative feedback of single positional information are focused on, in some cases, in the first mode, it may be difficult to detect a failure of any of the motors even when the motor has failed. More specifically, when a high-load task is performed, and if any of the motors has failed, the positional signal xdet from the encoder may be largely delayed or the drive instruction signal (current value or the like) generated by the control unit 91 may be delayed due to reduction of torque. Therefore, it is possible to detect occurrence of a failure on the basis of the positional signal xdet or the drive instruction signal obtained from the encoder. However, it is impossible to identify the motor that has failed.

Furthermore, in a case of a low-load task for which a single motor is adequate, even when any of the two motors has failed, the positional signal xdet from the encoder is not largely delayed, so that it is impossible to detect even occurrence of a failure of the motor.

In this manner, in the first mode, it is difficult to identify a failed motor and detect occurrence of a failure of a motor. Therefore, in the present embodiment, a check mode is provided, and the second mode or the third mode is executed to detect a failure of a motor.

Figure 8:
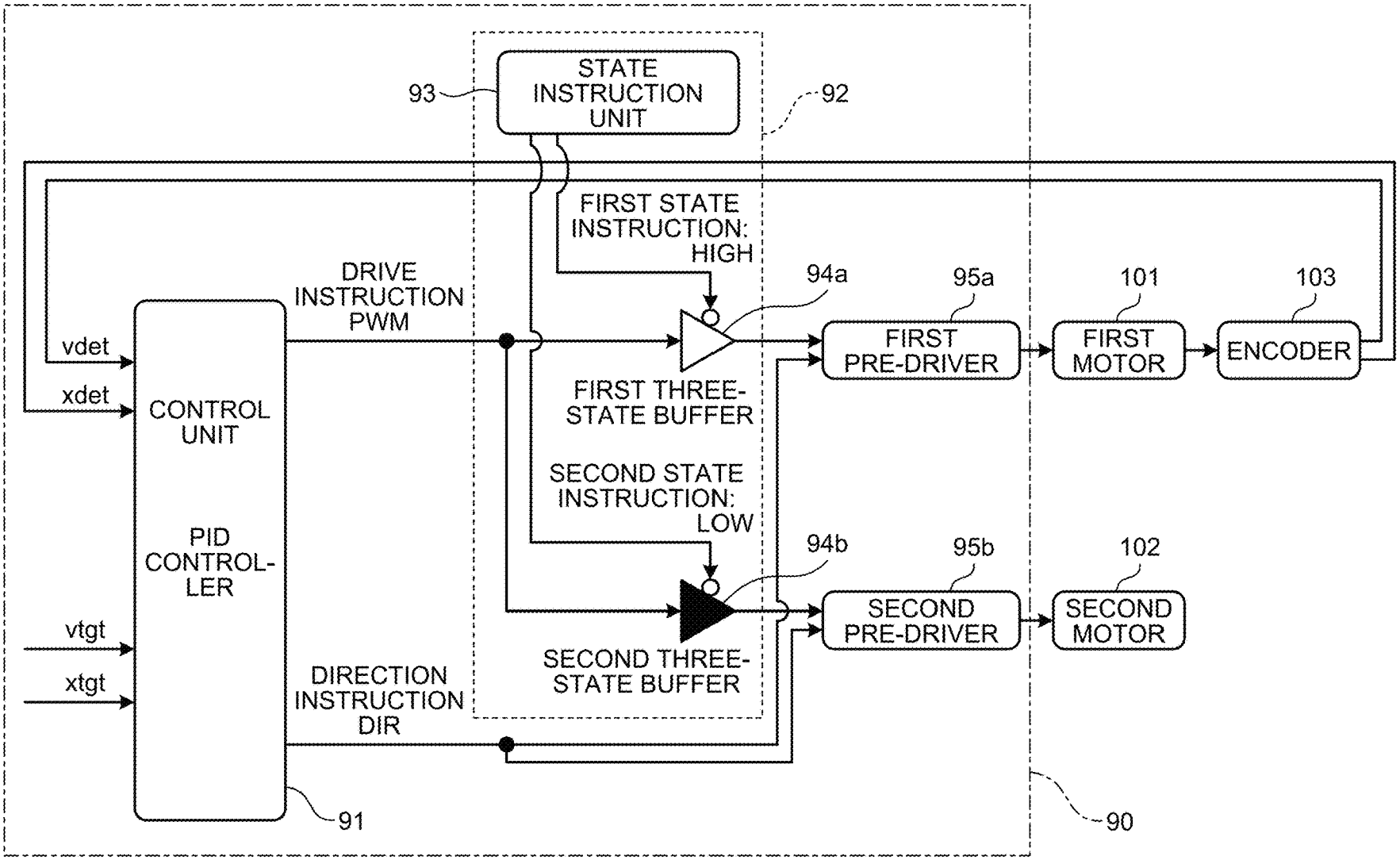
FIG. 8 is a block diagram of the drive control device while a second mode is executed.
Figure 9:
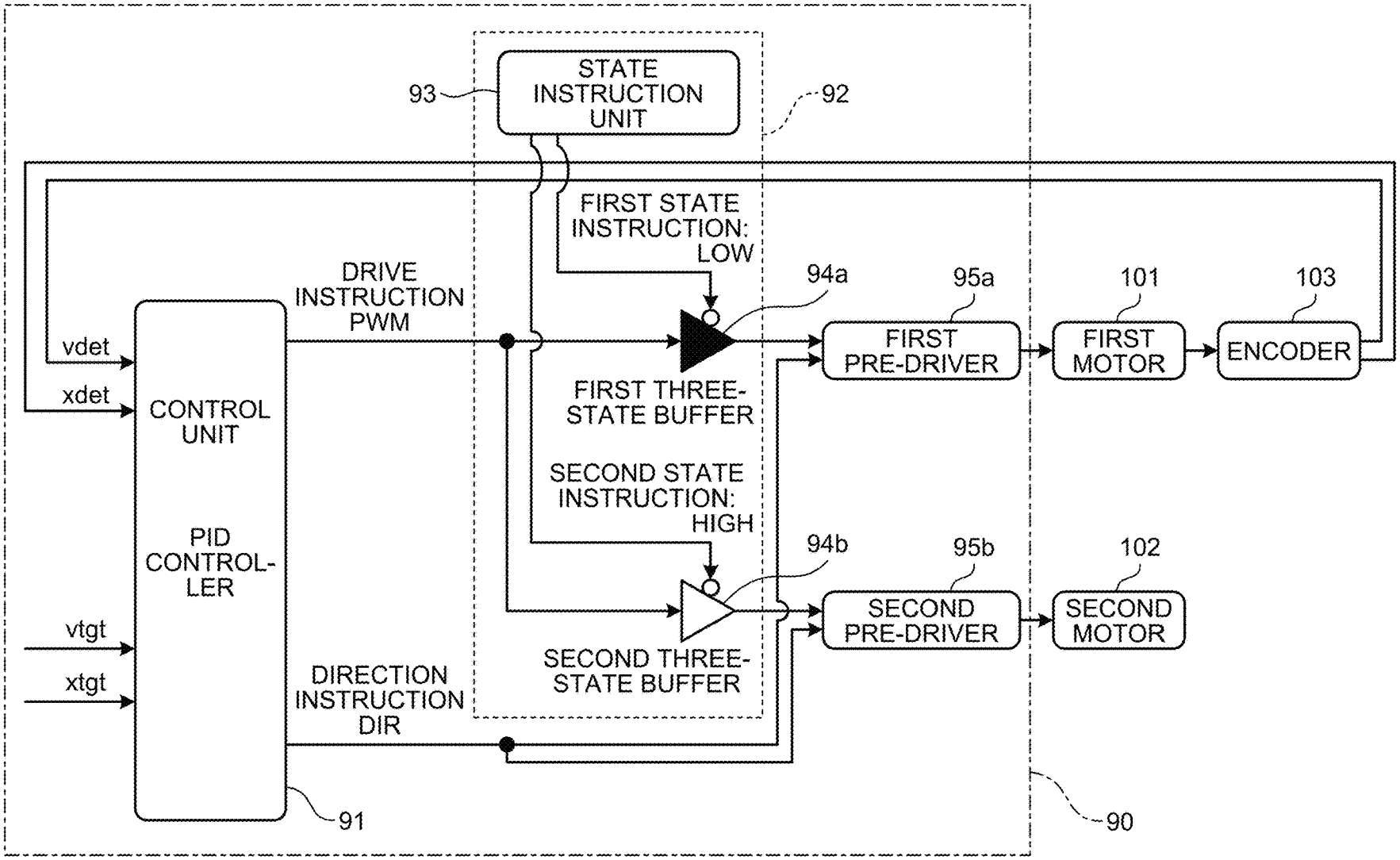
FIG. 9 is a block diagram of the drive control device while a third mode is executed.

FIG. 8 is a block diagram of the drive control device 90 while the second mode for driving only the first motor 101 that is one of the motors is executed, and FIG. 9 is a block diagram of the drive control device 90 while the third mode for driving only the second motor 102 is executed.

As illustrated in FIG. 8, in the second mode that is set at the time of checking a failure of the first motor 101, the state instruction unit 93 inputs the state instruction signal of High to the first three-state buffer 94*a* and inputs the state instruction signal of Low to the second three-state buffer 94*b*. Accordingly, the drive instruction signal (PWM signal) that is transmitted from the control unit 91 to the first motor 101 is transmitted to the first pre-driver 95*a*, so that the first motor 101 is driven. In contrast, the second three-state buffer 94*b* to which the state instruction signal of Low is input blocks the drive instruction signal (PWM signal) from the control unit. Accordingly, the drive instruction signal (PWM signal) is not input to the second pre-driver 95*b*, so that the second motor 102 is not driven. Consequently, only the first motor 101 is driven.

In contrast, as illustrated in FIG. 9, in the third mode that is set at the time of checking a failure of the second motor 102, the state instruction unit 93 inputs the state instruction signal of High to the second three-state buffer 94*b* and inputs the second state instruction signal of Low to the first three-state buffer 94*a*. Accordingly, the drive instruction signal (PWM signal) transmitted from the control unit 91 to the second motor 102 is transmitted to the second pre-driver 95*b*, so that the second motor 102 is driven. In contrast, the first three-state buffer 94*a* to which the state instruction signal of Low is input blocks the drive instruction signal (PWM signal) from the control unit. Accordingly, the drive instruction signal (PWM signal) is not input to the first pre-driver 95*a*, so that the first motor 101 is not driven. Consequently, only the second motor 102 is driven.

In the check mode as described above, the second mode is first executed for a predetermined time, and presence or absence of a failure of the first motor 101 is detected. At this time, the control unit 91 monitors whether there is abnormal output from the encoder 103. If the control unit 91 determines that there is abnormal output from the encoder, the control unit 91 determines that the first motor 101 has failed and gives a notice of occurrence of a failure in the first motor 101 to an operation display unit of the image forming apparatus.

In contrast, if the control unit 91 determines that the first motor 101 has not failed, the control unit 91 executes the third mode for a predetermined time and detects presence or absence of a failure of the second motor 102. If the control unit 91 determines that there is abnormal output from the encoder 103, the control unit 91 determines that the second motor 102 has failed and gives a notice of occurrence of a failure in the second motor 102 to the operation display unit of the image forming apparatus.

In the above-described example, a failure of the first motor 101 is first checked and thereafter a failure of the second motor 102 is checked; however, a failure of the second motor 102 may be checked after a failure of the first motor 101 is checked.

Furthermore, as the determination of a failure of the motor, the drive instruction signal, such as a drive current value or a PWM value, generated by the control unit 91 may be monitored to determine a failure of the motor by comparison with a threshold that is determined at the time of normal operation or determined in advance.

Moreover, if any of the motors has failed, feeding in one of the second mode and the third mode in which only the drive motor that has not failed is driven may be performed. Furthermore, in this case, it is preferable not to perform feed control (hereinafter, referred to as high-speed feed control) described in Japanese Laid-open Patent Publication No. 2005-213039, in which conveyance of the subsequent sheet P2 is temporarily suspended and it is necessary to extremely increase the speed when feeding is resumed after feeding of the subsequent sheet P2 is temporarily suspended.

The check mode as described above may be performed at the time of initialization operation that is initial operation performed when the device is turned on or resumes from a stand-by state. Furthermore, the check mode may be executed when the sheet feeding is completed. By executing the check mode only when the above-described sheet feeding is completed without executing the check mode at the time of the initialization operation, it is possible to reduce preparation time at the time of activation.

Moreover, the check mode may be executed when the feed roller 55 is temporarily suspended at the time of sheet feeding. When the check mode is executed at the time of temporarily suspending the feed roller 55, the direction instruction signal (DIR) transmitted by the control unit 91 is a direction instruction signal (DIR) for performing rotation in a direction opposite to a feed direction (rotation driving direction in the normal operation). With this configuration, in the check mode, the first motor 101 and the second motor 102 rotate in the direction opposite to the feed direction. As described above, the one-way clutch is connected to the rotary shaft 108 of the feed roller 55, so that when each of the motors 101 and 102 is rotated in the reverse direction, driving forces of the motors are not transmitted to the feed roller 55. Therefore, even when the check mode is executed while a sheet is sandwiched between the feed roller 55 and the separation roller 56, the sheet is not conveyed and the feeding is not affected. Furthermore, by executing the check mode at the time of temporarily suspending the feed roller 55, it is possible to frequently check failures of the motors.

Moreover, the feed roller 55 may be configured so as to be able to come in contact with and separate from the separation roller 56, and when the check mode is executed at the time of temporarily suspending the feed roller 55 during sheet feeding, the check mode may be executed while the feed roller is separated from the separation roller 56. Even with this configuration, it is possible to check the motors without influence on a sheet sandwiched between the feed roller 55 and the separation roller 56.

Furthermore, in the above-described check mode, the second mode and the third mode are executed to check operation of both of the first motor 101 and the second motor 102; however, operation of only any one of the motors may be checked. In this case, it is preferable to change a check target motor from the motor that has been checked in the previous check mode such that if operation of the first motor 101 is checked first, operation of the second motor 102 is checked in the subsequent check mode.

In the above-described example, the feed roller 55 during feeding as normal operation is driven in the first mode, and the second mode and the third mode are executed only when failures of the motors are checked; however, the embodiments are not limited thereto. For example, the operation mode may be changed depending on sheet types. Torque needed for feeding varies depending on a sheet thickness or surface roughness of the sheet P to be fed. Therefore, when feeding a sheet for which higher torque is needed for feeding, the feed roller 55 is driven in the first mode to stabilize a conveying speed. In contrast, when feeding a sheet for which lower torque is needed for feeding, the feed roller 55 may be derived in the second mode or the third mode to save power. It is preferable to determine which of the second mode and the third mode is executed to feed a sheet for which lower torque is needed for feeding, depending on use frequencies of the motors.

Furthermore, a high-speed mode and a power saving mode are provided. In the high-speed mode, high-speed feed control, which requires control of an increase in the speed of the feed roller as described above, is performed, so that the feed roller 55 is driven in the first mode. In contrast, in the power saving mode, the high-speed feed control is not performed, so that the feed roller 55 may be driven in the second mode or the third mode. Even in this case, it is preferable to determine which of the second mode and the third mode is used to perform feeding, depending on use frequencies, such as use duration, of the motors.

Moreover, for example, the feed roller 55 may be driven in the first mode only when the speed is increased to resume feeding after feeding of the subsequent sheet P2 is temporarily suspended in the high-speed feed control, and drive the feed roller 55 in any of the second mode and the third mode in other cases.

As described above, in the present embodiment, by providing the second mode for driving only the first motor 101 and the third mode for driving only the second motor 102, it is possible to check operation of each of the motors 101 and 102 and detect failures of the motors.

Furthermore, it is possible to switch among the first mode for driving all of the motors, the second mode for driving only the first motor 101, and the third mode for driving only the second motor 102 by using the three-state buffers that are simple integrated circuits. Therefore, it is possible to provide a driving device capable of switching between operation modes with simple and low-cost configuration.

Moreover, in the present embodiment, the three-state buffer is arranged in the drive instruction signal transmission line between the control unit and each of the drive sources, and switches between blocking and transmission of the drive instruction signal from the control unit; however, embodiments are not limited thereto. For example, a switch may be arranged instead of the three-state buffer, and change ON and Off of the switch to switch between blocking and transmission of the drive instruction signal. A user may be allowed to manually change ON and OFF of the switch or control ON and OFF of the switch by a device.

Figure 10:
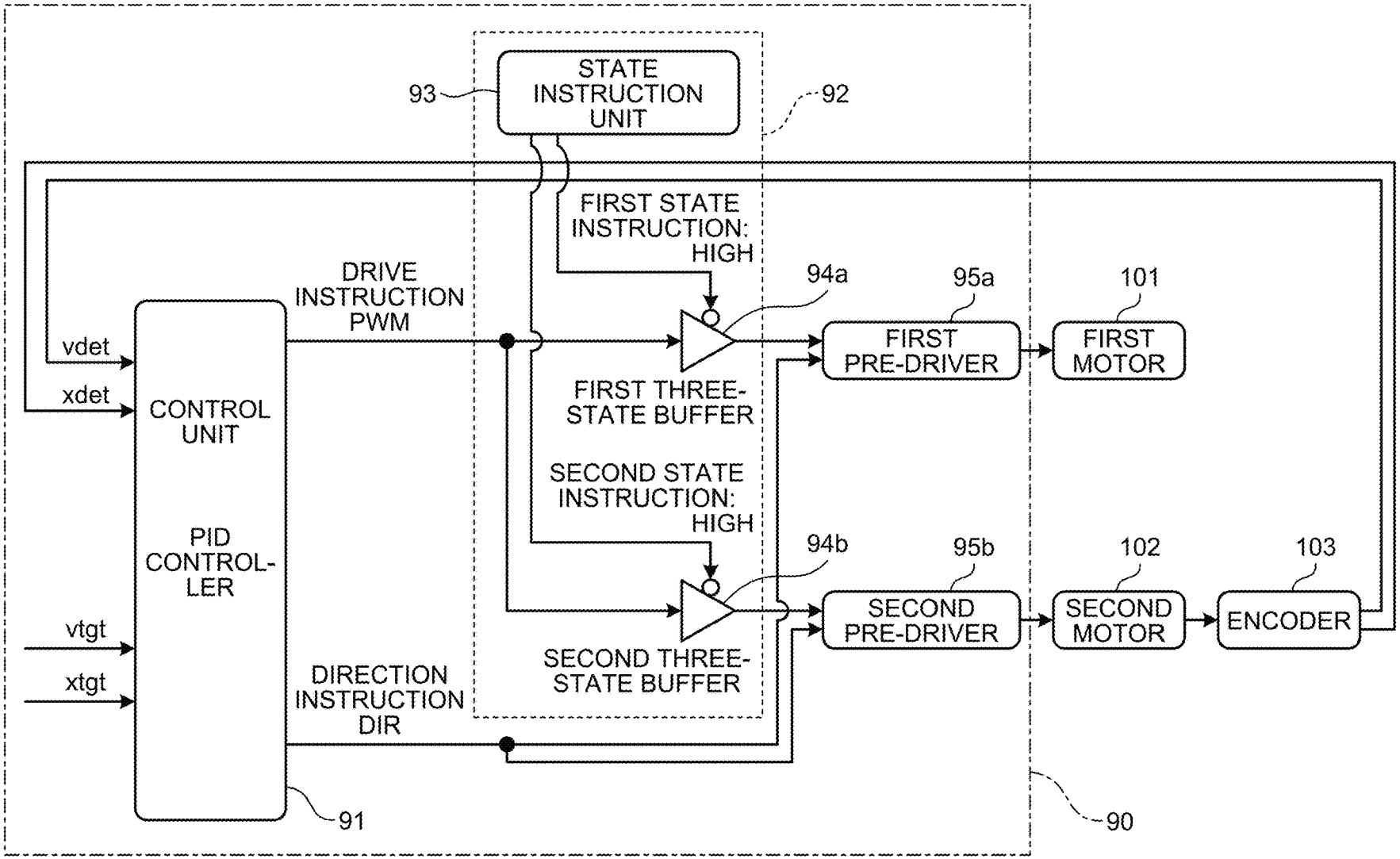
FIG. 10 is a block diagram of the drive control device in which an encoder is mounted on a second motor.
Figure 11:
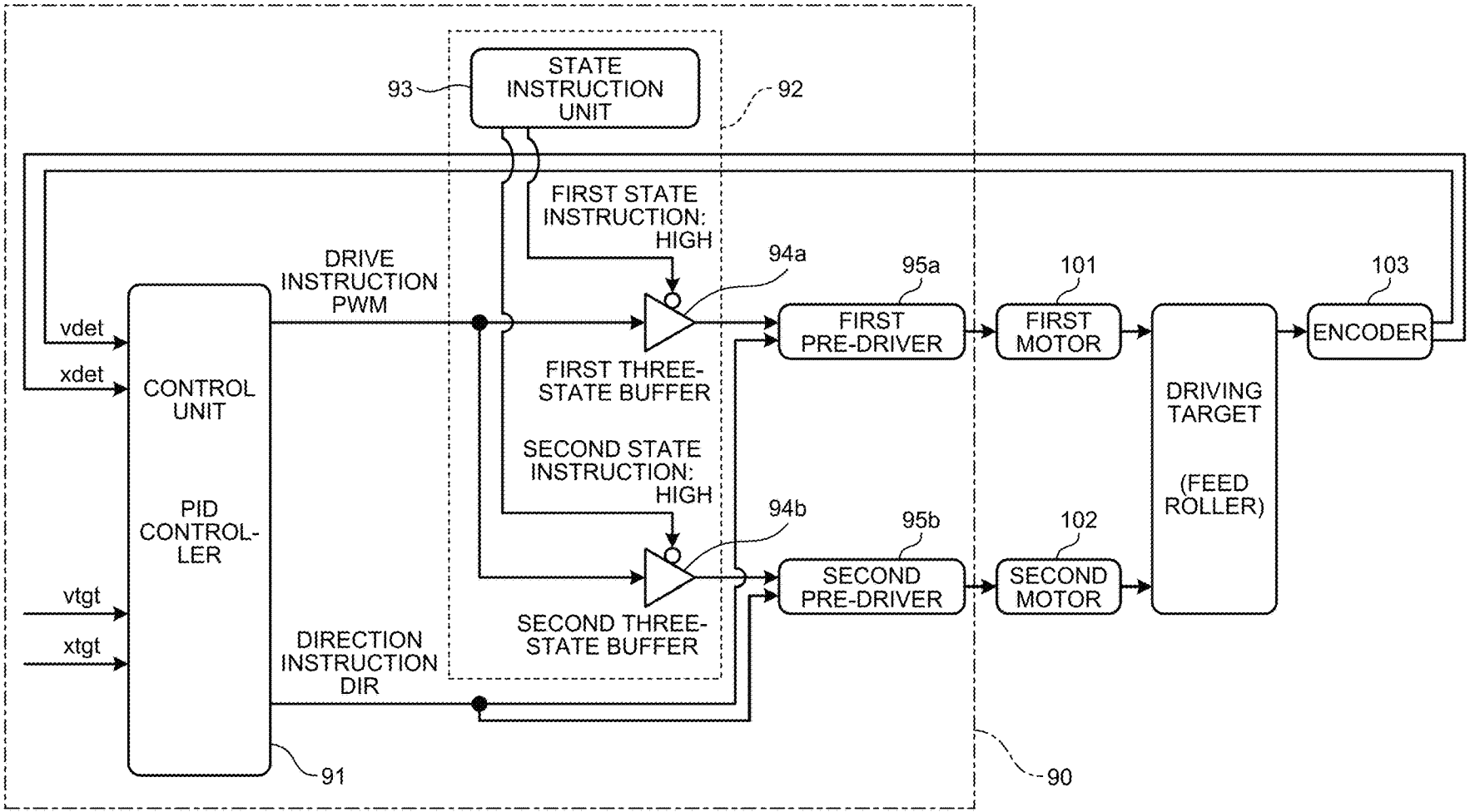
FIG. 11 is a block diagram of the drive control device in which the encoder is mounted on a driving target.

Furthermore, while the encoder 103 detects the shaft angle of the motor shaft 101*a* of the first motor 101 in the above-described example, embodiments are not limited thereto. For example, the shaft angle of the motor shaft 102*a* of the second motor 102 may be detected as illustrated in FIG. 10, or a shaft angle of the shaft 108 of a driving target (the feed roller 55) to be driven by the plurality of motors may be detected as illustrated in FIG. 11.

Moreover, the encoder 103 may be incorporated in the motor, or may generate the positional signal xdet and the angular velocity vdet by using an internal signal of the motor and give feedback of them to the control unit 91. Furthermore, encoders may be provided in both of the first motor 101 and the second motor 102, and give feedback to the control unit 91 in a selective manner or after performing calculation, such as an averaging process, on the positional signals xdet and the angular velocities vdet of the plurality of encoders. If the encoder is provided for each of the motors as described above, costs for the device increases as compared to a device in which a single encoder shared by the motors is provided as described above. However, the control unit that generates and transmits the drive control signal and detects failures is a single control unit shared by the motors, so that it is possible to reduce costs and a device size as compared to a conventional technique in which the control unit is provided for each of the motors.

Figure 12:
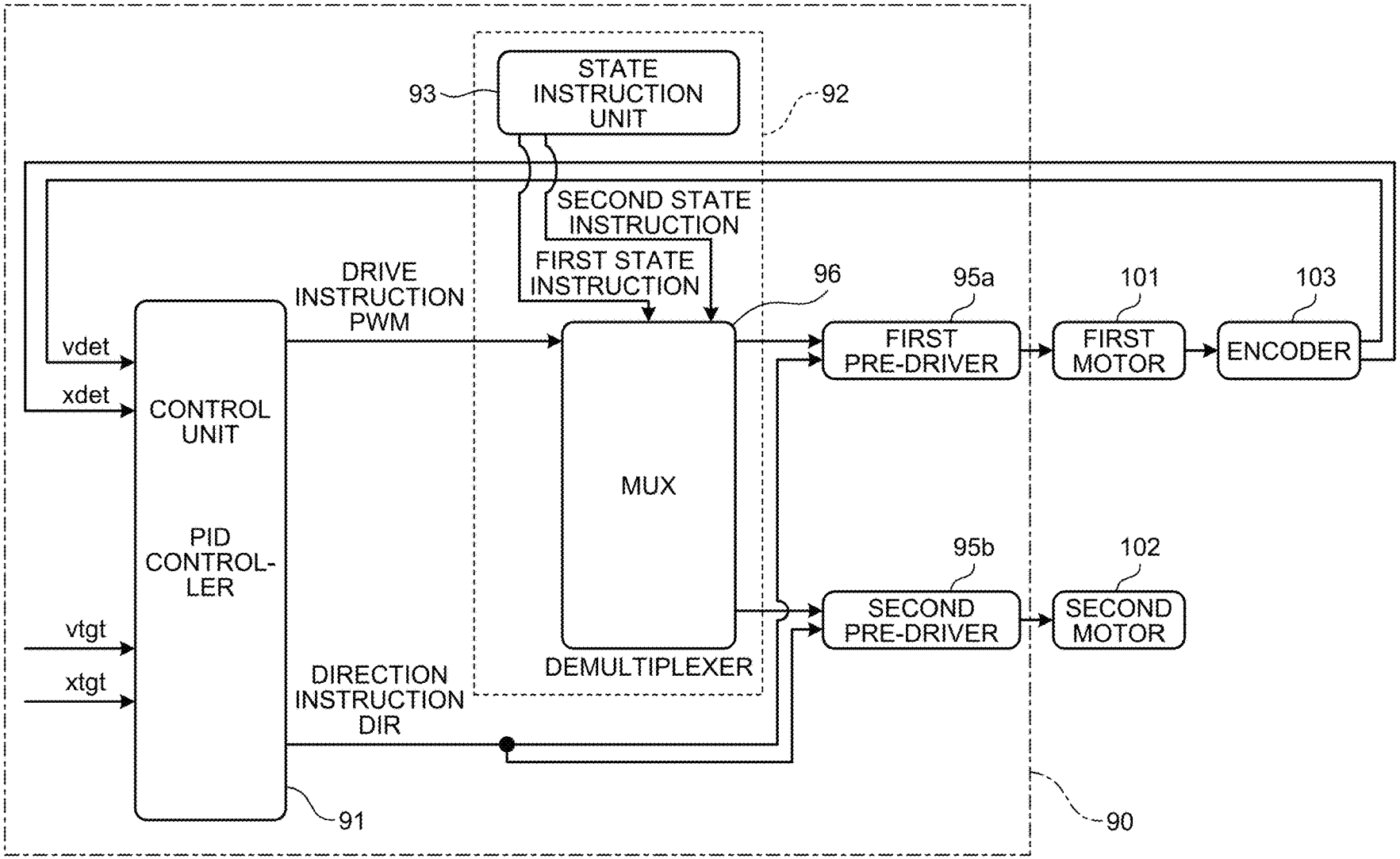
FIG. 12 is a block diagram of the drive control device that changes an operation mode using a demultiplexer.

FIG. 12 is a diagram illustrating the drive control device 90 configured to switch among the operation modes by using a demultiplexer instead of the three-state buffers.

A demultiplexer 96 includes four output channels. For example, a first output channel is connected to both of the first pre-driver 95*a* and the second pre-driver 95*b*, and the second output channel is connected to only the first pre-driver 95*a*. Further, a third output channel is connected to only the second pre-driver 95*b*, and a fourth output channel is not connected to any of the pre-drivers.

Furthermore, the output channels are switched depending on a combination of a first state instruction signal (High/

Low) and a second state instruction signal (High/Low) input from the state instruction unit 93. For example, when both of the first state instruction signal and the second state instruction signal are set to High, a signal input to the first output channel is output. Therefore, when both of the first state instruction signal and the second state instruction signal are set to High, the drive instruction signal from the control unit 91 is transmitted to the first pre-driver 95*a* and the second pre-driver 95*b*, so that the first mode is executed.

When the first state instruction signal is set to High and the second state instruction signal is set to Low, a signal input to the second output channel is output. Therefore, in this case, the drive instruction signal from the control unit 91 is transmitted to only the first pre-driver 95*a*, so that the second mode is executed.

Furthermore, when the first state instruction signal is set to Low and the second state instruction signal is set to High, a signal input to the third output channel is output. Therefore, in this case, the drive instruction signal from the control unit 91 is transmitted to only the second pre-driver 95*b*, so that the third mode is executed.

In this manner, even in the configuration using the demultiplexer 96, it is possible to switch between the operation modes and check the motors.

While the example using the demultiplexer 96 has been described above, embodiments are not limited thereto, and any IC capable of selecting or changing an output destination is applicable. Furthermore, in the above-described example, transmission and non-transmission of only the drive instruction signal (PWM signal) to each of the motors among drive control signals transmitted from the control unit 91 to the motors are selectively switched, but selective switching between transmission and non-transmission of other signals, such as the direction instruction signal and a brake instruction signal, that are transmitted from the control unit to each of the motors, may be also performed.

Figure 13:
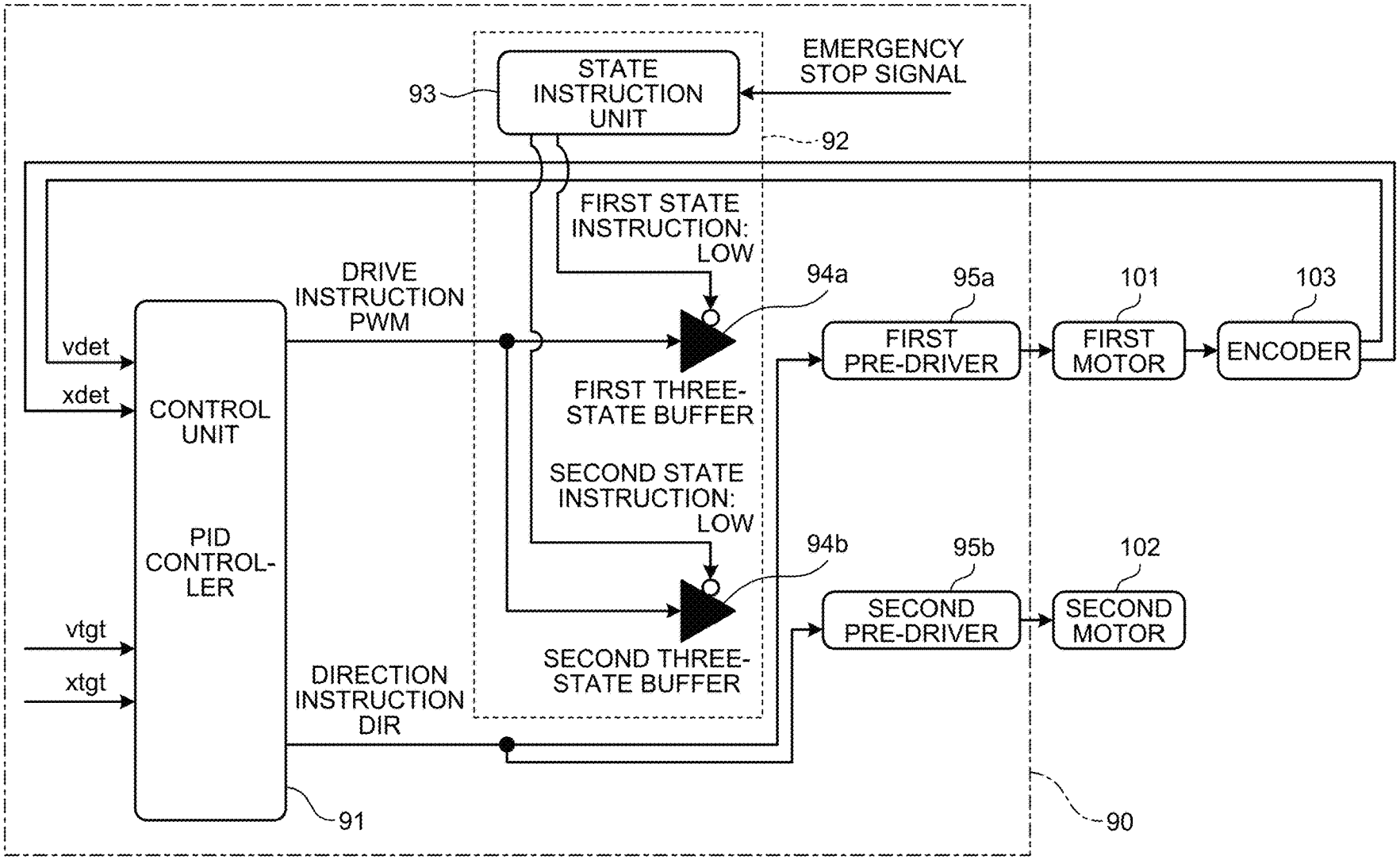
FIG. 13 is a block diagram of the drive control device for explaining control at the time of emergency stop.

FIG. 13 is a block diagram of the drive control device 90 for explaining control at the time of emergency stop.

In a normal state, each of the motors 101 and 102 is stopped by stopping transmission of the drive control signal (the drive instruction signal, the direction instruction signal, or the like) from the control unit 91; however, in FIG. 13, as a multiple safety circuit, at the time of emergency, the mode switch unit 92 is caused to control stoppage of drive of each of the motors 101 and 102, in addition to the control unit that controls stoppage of the drive.

If the state instruction unit 93 receives an emergency stop signal from a main control unit or the like that controls the entire image forming apparatus, the state instruction unit 93 inputs the state instruction signal of Low to each of the three-state buffers 94*a* and 94*b*. Accordingly, each of the three-state buffers 94*a* and 94*b* blocks the drive instruction signal (PWM) from the control unit. Consequently, the drive instruction signal (PWM) is not input to each of the pre-drivers 95*a* and 95*b*, and each of the motors 101 and 102 is stopped. In this manner, by causing the mode switch unit 92 to control stoppage of the drive of each of the motors 101 and 102, even when transmission of the drive instruction signal (PWM) from the control unit 91 is not stopped because of some reasons, it is possible to reliably stop each of the motors 101 and 102 and improve the safety of the device.

Furthermore, a user may be allowed to select an operation mode.

Figure 14:
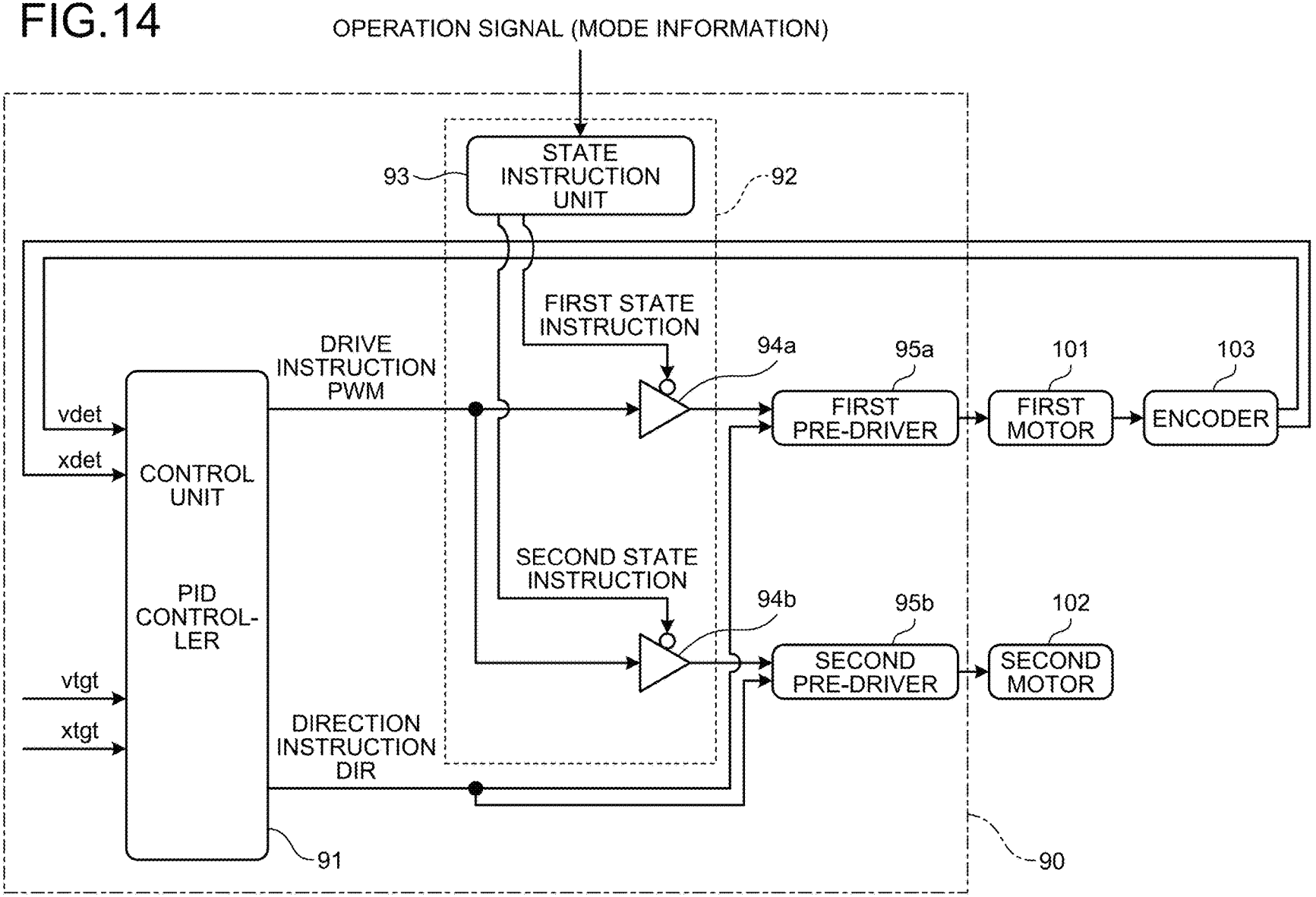
FIG. 14 is a block diagram of the drive control device for explaining a change of the operation mode through user operation.
Figure 15:
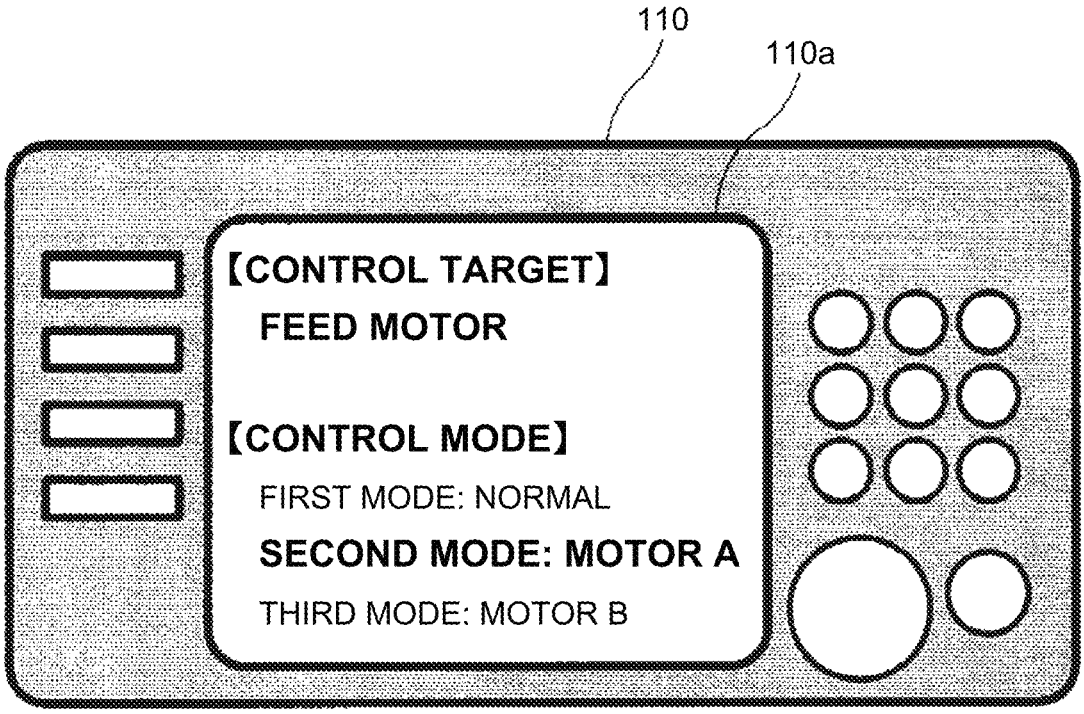
FIG. 15 is a diagram illustrating an example of display of an operating unit of an image forming apparatus when the operation mode is changed.

FIG. 14 is a block diagram of the drive control device 90 for explaining a change of the operation mode through user operation, and FIG. 15 is a diagram illustrating an example of display of an operating unit 110 of the image forming apparatus when the operation mode is changed.

When the user operates the operating unit 110, a mode selection screen 110*a* as illustrated in FIG. 15 is displayed. The user operates the operating unit, and selects one of the three modes displayed on the operating unit 110 (in the example in FIG. 15, the second mode is selected). Mode information on the mode selected through the operation on the operating unit 110 is input, as an operation signal, to the state instruction unit 93 as illustrated in FIG. 14. The state instruction unit inputs the state instruction signal to each of the three-state buffers on the basis of the input operation signal. As illustrated in FIG. 15, when the user selects the second mode, the state instruction unit 93 inputs the state instruction signal of High to the first three-state buffer 94*a* and inputs the state instruction signal of Low to the second three-state buffer 94*b*. Therefore, the drive instruction signal of the control unit 91 is transmitted to the first pre-driver 95*a*, so that the first motor 101 is driven, and, transmission of the drive instruction signal to the second pre-driver 95*b* is blocked, so that the second motor is not driven; thus, the second mode in which only the first motor 101 is driven is executed.

Meanwhile, while the mode is selected by operating the operating unit 110 in the above-described example, a mode change switch (lever) may be provided to select a mode by operating the lever.

In this manner, by allowing a user to select the operation mode, if an operation failure occurs in one of the two motors for example, it is possible to select an operation mode for driving only the motor that normally operates and perform temporary operation while the motor having the operation failure is replaced.

Furthermore, a user may be allowed to perform a failure check on the motors by operating the operating unit 110. In this configuration, the check mode is executed based on failure check execution instruction signal serving as the operation signal.

Moreover, while drive control on the driving device in which the two motors drive a single driving target has been described above, the present invention is applicable to drive control on a driving device in which three or more motors drive a single driving target. Furthermore, it is sufficient that a plurality of motors are able to perform feedback control, and it is acceptable that the motors have different capacities or systems.

Furthermore, while the example has been described above in which the feed roller 55 is driven by the plurality of motors, the driving target is not limited thereto, and the driving device of the present embodiment is applicable to any device that is driven to rotate. In particular, it is preferable to apply the present technique to operation of driving the feed roller 55 of the sheet feed device as described above, or a sheet conveying roller, such as the grip roller 58 or the timing roller pair 13 serving as the conveying roller. A large-scale image forming apparatus among image forming apparatuses handles a large sheet size and a large sheet thickness, and it is necessary to cope with a high speed or an increased speed as described above in order to ensure high productivity, so that it is necessary to realize high output; therefore, the driving device of the present embodiment that drives a single driving target by a plurality of motors is preferably applied to operation of driving a conveying roller that conveys a sheet.

Moreover, a document conveying roller of an auto document feeder (ADF) or the like also needs to cope with a high speed or an increased speed as described above in order to ensure bight productivity and needs to realize high output, so that the driving device of the present embodiment that drives a single driving target by a plurality of motors is preferably used.

The above-described cases are one example, and specific effects are achieved for each of the following aspects.

(Aspect 1)

The drive control device 90 that controls a plurality of drive sources, such as motors, for driving a single output shaft includes the control unit 91 that generates a single drive control signal and transmits the drive control signal to the plurality of drive sources. The drive control device 90 has, as operation modes, a first driving mode for driving the plurality of drive sources and a second driving mode for driving a part of the drive sources.

When the plurality of drive sources perform driving, even if any of the drive sources has failed, the other drive sources transmit driving forces to a driving target and the driving target continues to rotate. Therefore, in some cases, it may be difficult to detect failures of the drive sources.

In the configuration described in Japanese Laid-open Patent Publication No. 2005-213039, a control unit that controls drive of each of drive sources is provided, and drive control is performed in accordance with a drive state of each of the drive sources; therefore, it is relatively easy to recognize presence or absence of a failure of the drive source that is handled by each of the control units.

However, in a configuration in which the control unit generates and transmits a single drive control signal to the plurality of drive sources, it is difficult to detect a failure of each of the drive sources due to the characteristics of the control.

Therefore, in Aspect 1, the second mode for driving only a part of the drive sources is provided in addition to the first mode for driving all of the drive sources. When the second mode is executed, and if a part of the drive sources that are driven has failed, abnormality occurs in the drive of the driving target, so that, it is possible to detect presence or absence of a failure in a part of the drive sources.

Consequently, even in the configuration in which a single control unit is provided, it is possible to detect presence or absence of a failure of the drive source, so that it is possible to detect a failure while reducing a size and costs of the device.

(Aspect 2)

In Aspect 1, the check mode for checking operation of the drive sources is provided, and the second driving mode is executed in the check mode.

Therefore, it is possible to check presence or absence of a failure of a part of the drive sources.

(Aspect 3)

The drive control device 90 that controls a plurality of drive sources, such as motors, for driving a single output shaft includes the control unit 91 that generates a single drive control signal and transmits the drive control signal to the plurality of drive sources. The drive control device 90 has, as operation modes, at least a first mode for driving both of a first drive source and a second drive source of the plurality of drive sources, a second mode for pricing only the first drive source of the plurality of drive sources, and a third mode for driving only the second drive source of the plurality of drive sources.

With this configuration, as described in the embodiment, when the second mode is executed, and if the first drive source that is driven has failed, abnormality occurs in the drive of the driving target, so that it is possible to detect presence or absence of a failure of the first drive source. Furthermore, when the third mode is executed, and if the second drive source that is driven has failed, abnormality occurs in the drive of the driving target, so that it is possible to detect presence or absence of a failure of the second drive source.

Consequently, it is possible to detect a failure of each of the first drive source and the second drive source while reducing a size and costs of the device.

(Aspect 4)

In Aspect 3, the drive control device has a check mode for checking operation of the drive sources, and at least one of the second mode and the third mode is executed in the check mode.

With this configuration, as described in the embodiment, it is possible to detect presence or absence of failures of the first drive source and the second drive source.

(Aspect 5)

In Aspect 2 or 4, when the check mode is executed, a driving target, such as the feed roller 55, to which a driving force is transmitted via the output shaft is separated from a member with which the driving target comes in contact.

With this configuration, as described in the embodiment, it is possible to prevent, in the check mode, a driving force from being transmitted to the member that comes in contact with the driving target.

(Aspect 6)

In Aspect 2 or 4, in the check mode, rotary drive is performed in a direction opposite to a rotary drive direction at the time of normal operation, such as feeding.

With this configuration, as described in the embodiment, by only arranging a one-way clutch on a drive transmission line between the drive source, such as the motor, and the driving target, such as the feed roller 55, it is possible to prevent the driving target from rotating in the check mode. Consequently, only with a simple configuration, it is possible to prevent a driving force from being transmitted to the member that comes in contact with the driving target in the check mode.

(Aspect 7)

In Aspects 2 and 4 to 6, the check mode is executed when the drive control device is turned on or resumes from the stand-by state.

With this configuration, by executing the check mode in the initialization operation (initial operation) that is performed when the device is turned on or resumes from the stand-by state, it is possible to detect presence or absence of a failure of the drive source before starting to use the device.

(Aspect 8)

In Aspects 2 and 4 to 6, the check mode is executed at the time of terminating the drive control.

With this configuration, as described in the embodiment, it is possible to activate the device at an earlier timing as compared to a case in which the check mode is executed when the device is turned on or resumes from the stand-by state.

(Aspect 9)

In Aspects 2 and 4 to 6, the check mode is executed at the time of temporary suspension during normal operation, such as sheet feed operation.

With this configuration, as described in the embodiment, it is possible to frequently check the drive sources.

(Aspect 10)

In any of Aspects 1 to 9, the mode switch unit 92 that switches among the operation modes is provided. The mode switch unit 92 selectively switches, for each driving source, whether to output the drive control signal received from the control unit 91 to the drive source.

With this configuration, as described in the embodiment, even when the single drive control signal is transmitted from the control unit 91 to each of the drive sources, it is possible to transmit the drive control signal to only the drive source corresponding to the operation mode and drive only the drive source corresponding to the operation mode.

(Aspect 11)

In Aspect 10, the mode switch unit 92 includes a plurality of signal blocking units, each of which is arranged in one of drive control signal transmission lines between the control unit 91 and the drive sources and capable of blocking the drive control signal.

With this configuration, as described in the embodiment, by blocking the drive control signal by the signal blocking units, the drive control signal is not input to a drive source for which the signal is blocked, and the drive source is not driven. Therefore, by controlling the signal blocking units arranged in each of the transmission lines, it is possible to selectively switch whether to output the drive control signal received from the control unit 91 to the drive sources.

(Aspect 12)

In Aspect 11, the signal blocking units are three-state buffers.

With this configuration, as described in the embodiment, it is possible to construct the signal blocking units by simple integrated circuits, so that it is possible to prevent an increase in costs of the device.

(Aspect 13)

In Aspect 10, the mode switch unit includes a demultiplexer.

Even with this configuration, it is possible to switch among the operation modes by a simple integrated circuit and prevent an increase in costs of the device.

(Aspect 14)

In any of Aspects 10 to 13, when emergency stop is performed, the mode switch unit does not output the received drive control signal to all of the drive sources.

With this configuration, as described in the embodiment, it is possible to set the mode switch unit so as not to output the drive control signal to stop drive of the plurality of drive sources, in addition to normal drive stop operation of stopping transmission of the drive control signal from the control unit 91. Therefore, it is possible to control stop of the drive in a duplicate manner. Consequently, at the time of emergency stop, it is possible to reliably stop the drive and improve safety of the device.

(Aspect 15)

In any of Aspects 1 to 14, an operation mode is selected based on user instruction information from an operating unit.

With this configuration, as described in the embodiment, it is possible to allow a user to select an operation mode, and if any of the motors has failed, it is possible to perform temporary operation until recovery by operating the device with the motor that has not failed.

(Aspect 16)

In a driving device that includes a plurality of drive sources for driving a single output shaft and a drive control unit that controls the plurality of drive sources, the drive control device of any of Aspects 1 to 15 is used as the drive control unit.

With this configuration, it is possible to provide a small device at a low cost.

(Aspect 17)

In a sheet conveying device that includes a sheet conveying member that conveys a sheet and a driving device that drives the sheet conveying member by a plurality of drive sources, the driving device of Aspect 16 is used as the driving device.

With this configuration, as described in the embodiment, it is possible to reduce costs and a size of the device, stably convey a sheet, such as paper, and detect a failure of each of the drive sources.

(Aspect 18)

In Aspect 17, the sheet conveying member is a sheet feed conveying roller, such as the feed roller 55.

With this configuration, as described in the embodiment, it is possible to prevent an increase in costs and stably convey a sheet.

(Aspect 19)

In an image forming apparatus that includes a plurality of drive sources for driving a single output shaft and a drive control unit that controls the plurality of drive sources, the drive control device according to any one of Aspects 1 to 15 is used as the drive control means.

With this configuration, it is possible to reduce costs and a size of the device and detect a failure of each of the drive sources.

(Aspect 20)

In a drive control method of controlling a plurality of drive sources for driving a single output shaft, the drive control method has a first mode for driving all of the drive sources by transmitting a single drive control signal to all of the drive sources and a check mode for driving a part of the drive sources by transmitting a single drive control signal to the part of the drive sources.

With this configuration, it is possible to reduce costs and a size of the device and detect a failure of each of the drive sources.

According to an embodiment, it is possible to reduce a size and costs of a device and detect a failure of a drive source.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A drive control device configured to control a plurality of drive sources configured to drive a single output shaft, the drive control device comprising:

circuitry configured to generate a single drive control signal and transmit the drive control signal to the plurality of drive sources, wherein the drive control device has, as operation modes, a first mode for driving the plurality of drive sources and a second mode for driving a part of the plurality of drive sources, the drive control device has a check mode for checking operation of the plurality of drive sources, and the second mode is executed in the check mode.

2. The drive control device according to claim 1, wherein when the check mode is executed, a driving target to which a driving force is transmitted via the output shaft is separated from a member with which the driving target comes in contact.

3. The drive control device according to claim 1, wherein in the check mode, rotary drive is performed in a direction opposite to a rotary drive direction at a time of normal operation.

4. The drive control device according to claim 1, wherein the check mode is executed when the drive control device is turned on or resumes from a stand-by state.

5. The drive control device according to claim 1, wherein the check mode is executed at a time of terminating drive control.

6. The drive control device according to claim 1, wherein the check mode is executed at a time of temporary suspension during normal operation.

7. The drive control device according to claim 1, further comprising:

a mode switch unit configured to switch among the operation modes, wherein the mode switch unit is configured to selectively switch, for each driving source of the plurality of drive sources, whether to output the drive control signal received from the circuitry to the drive source.

8. The drive control device according to claim 7, wherein the mode switch unit includes a plurality of signal blocking units, each of which is arranged in one of drive control signal transmission lines between the circuitry and the plurality of drive sources and capable of blocking the drive control signal.

9. The drive control device according to claim 8, wherein the plurality of signal blocking units are three-state buffers.

10. The drive control device according to claim 7, wherein the mode switch unit includes a demultiplexer.

11. The drive control device according to claim 7, wherein when emergency stop is performed, the mode switch unit is configured to output the received drive control signal to none of the plurality of drive sources.

12. The drive control device according to claim 1, wherein an operation mode is selected based on user instruction information from an operating unit.

13. A driving device comprising:

a plurality of drive sources configured to drive a single output shaft; and drive circuitry configured to control the plurality of drive sources, wherein the drive control device according to claim 1 is used as the drive circuitry.

14. A sheet conveying device comprising:

a sheet conveying member configured to convey a sheet; and the driving device according to claim 13 configured to drive the sheet conveying member by the plurality of drive sources.

15. The sheet conveying device according to claim 14, wherein the sheet conveying member is a sheet feed conveying roller.

16. An image forming apparatus comprising:

a plurality of drive sources configured to drive a single output shaft; and drive circuitry configured to control the plurality of drive sources, wherein the drive control device according to claim 1 is used as the drive circuitry.

* * * * *